US007896999B2

(12) United States Patent
Marschke et al.

(10) Patent No.: US 7,896,999 B2
(45) Date of Patent: Mar. 1, 2011

(54) METHOD OF FORMING OPEN CORE WEB ELEMENTS

(75) Inventors: Carl R. Marschke, Phillips, WI (US); Michael B. Hladilek, Phillips, WI (US); David G. Flessert, Phillips, WI (US)

(73) Assignee: Carl R. Marschke, Phillips, WI (US)

( * ) Notice: Subject to any disclaimer, the term of this patent is extended or adjusted under 35 U.S.C. 154(b) by 421 days.

(21) Appl. No.: 12/137,941

(22) Filed: Jun. 12, 2008

(65) Prior Publication Data

US 2008/0236730 A1 Oct. 2, 2008

Related U.S. Application Data

(63) Continuation-in-part of application No. 11/951,617, filed on Dec. 6, 2007, which is a continuation-in-part of application No. 11/769,879, filed on Jun. 28, 2007, which is a continuation-in-part of application No. 11/476,474, filed on Jun. 28, 2006, now Pat. No. 7,459,049.

(51) Int. Cl.
*B31F 1/24* (2006.01)
*B31F 1/28* (2006.01)

(52) U.S. Cl. ..... 156/207; 156/259; 156/264

(58) Field of Classification Search ..... None
See application file for complete search history.

(56) References Cited

U.S. PATENT DOCUMENTS 3,025,963 A * 3/1962 Bauer ..... 210/493.4
3,434,901 A 3/1969 Griffiths et al.
3,707,817 A 1/1973 Schmitt et al.
3,943,994 A 3/1976 Cleveland
4,012,276 A 3/1977 Schertler
4,126,508 A 11/1978 Hoelzinger
4,500,381 A 2/1985 Nordstrom
4,948,445 A 8/1990 Hees
5,674,593 A 10/1997 Earl
5,992,112 A 11/1999 Josey
6,253,530 B1 7/2001 Price et al.
6,405,509 B1 6/2002 Razl
6,467,223 B1 10/2002 Christley
6,711,872 B2 3/2004 Anderson
6,800,351 B1 10/2004 Pflug et al.
6,890,398 B2 5/2005 Sing
6,913,667 B2 7/2005 Nudo et al.

(Continued)

FOREIGN PATENT DOCUMENTS

FR 1212042 3/1960

(Continued)

OTHER PUBLICATIONS

International Search Report dated Jan. 15, 2008.

(Continued)

*Primary Examiner* — John L. Goff
*Assistant Examiner* — Barbara J. Musser
(74) *Attorney, Agent, or Firm* — Andrus, Sceales, Starke & Sawall, LLP

(57) ABSTRACT

A continuous, fully automated and highly productive system for the production of open core elements utilizes a fluting method and related apparatus effective for providing large pitch flutes for the input webs used in forming the core elements. A wide variety of core elements can be produced for uses ranging from large light weight building panels to small light weight packing elements.

3 Claims, 22 Drawing Sheets

U.S. PATENT DOCUMENTS

| | | | | |
|---|---|---|---|---|
| 2002/0062611 | A1 | 5/2002 | Pryor | |
| 2002/0064629 | A1* | 5/2002 | Yoshii | 428/184 |
| 2002/0069993 | A1 | 6/2002 | Gilgen | |
| 2008/0000580 | A1* | 1/2008 | Marchke | 156/264 |

FOREIGN PATENT DOCUMENTS

| | | |
|---|---|---|
| FR | 1373515 | 9/1964 |
| GB | 783362 | 9/1957 |
| GB | 1444346 | 7/1976 |

OTHER PUBLICATIONS

Ruzzene, Massimo et al, Control of Wave Propagation in Sandwich Plate Rows with Periodic Honeycomb Core; Journal of Engineering Mechanics; Sep. 2003; pp. 1-12.

Wadley, Haydn N.G. et al, Fabrication and structural performance of periodic cellular metal sandwich structures; Composites Science and Technology, vol. 63, 2003, pp. 2331-2343.

Zupan, M. et al, The out-of-plane compressive behaviour of woven-core sandwich plates; European Journal of Mechanics A/Solids, vol. 23, 2004, pp. 411-421.

Seidl,R.J. et al. National Advisory Committee for Aeronautics; Technical Note 2564; Properties of Honeycomb Cores as Affected by Fiber Type, Fiber Orientation, Resin Type, and Amount; Forest Products Laboratory; Nov. 1951.

Seidl, Roebrt J. et al; Paper-Honeycomb Cores for Structural Sandwich Panels; United States Department of Agriculture Forest Services; Report No. 1918; Jul. 1956.

* cited by examiner

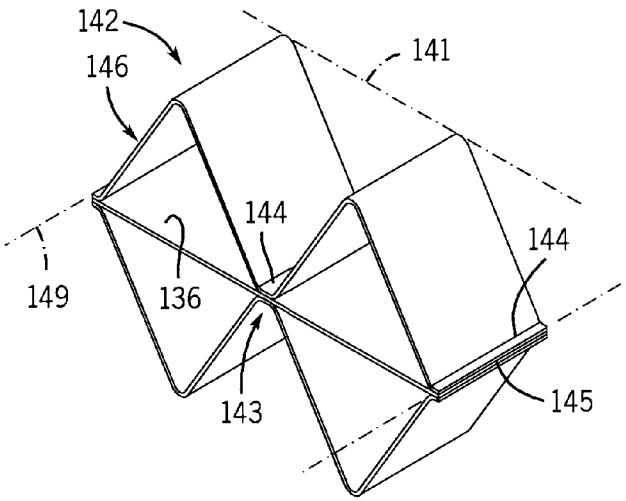
FIG. 22
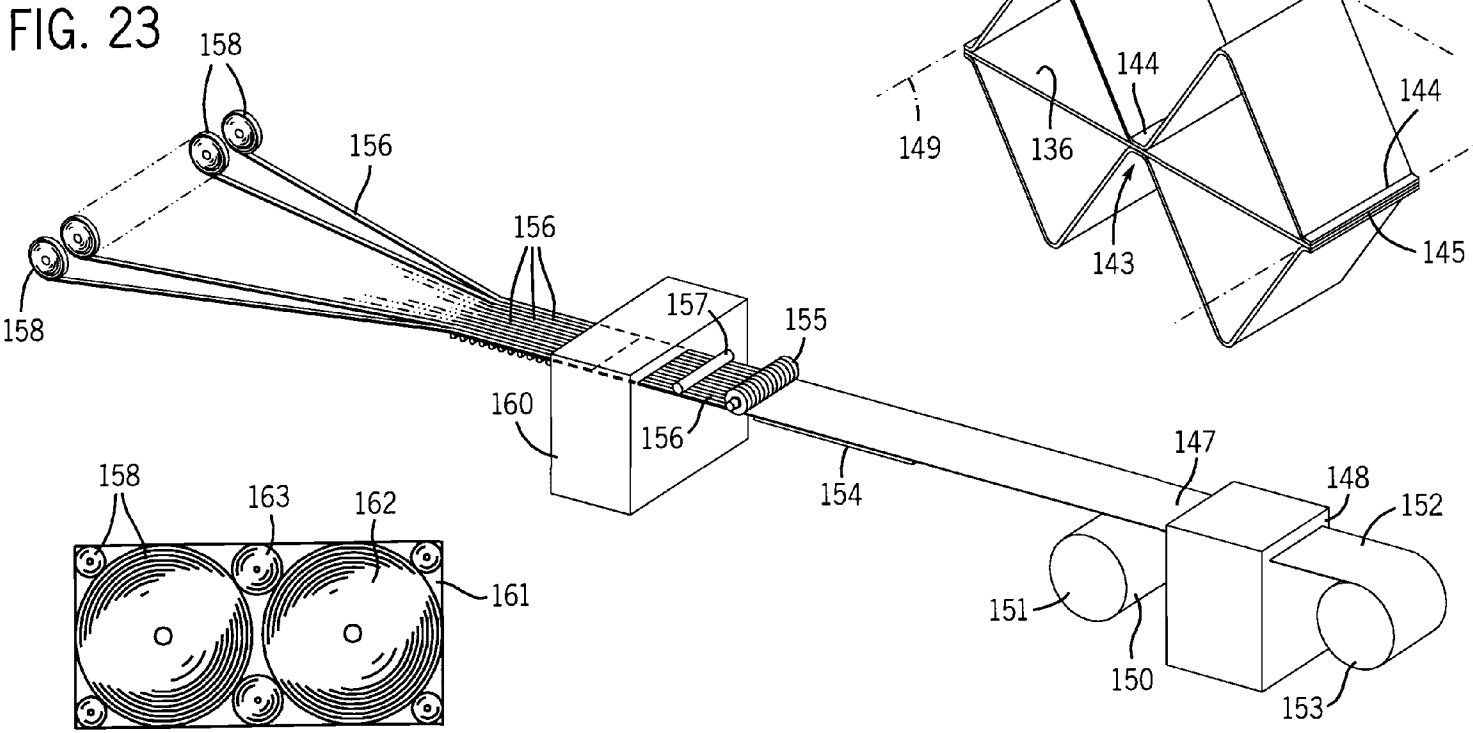
FIG. 23
FIG. 24

METHOD OF FORMING OPEN CORE WEB ELEMENTS

CROSS REFERENCE TO RELATED APPLICATIONS

This is a continuation-in-part of application Ser. No. 11/951,617, filed Dec. 6, 2007, which is a continuation-in-part of application Ser. No. 11/769,879 filed Jun. 28, 2007, which is a continuation-in-part of application Ser. No. 11/476,474, filed Jun. 28, 2006 now U.S. Pat. No. 7,459,049.

BACKGROUND OF THE INVENTION

The present invention pertains light weight open core materials having a honeycomb-like structure useful in a number of applications where light weight core elements are desirable or necessary.

It has long been known to utilize honeycomb core materials in the manufacture of structural members such as doors, wall panels and floor panels. The honeycomb core material may be made from paper, metal or even plastic web material. Conventional honeycomb construction may utilize paper strips laid together in a stack and connected to one another with intermittent lengths of adhesive, and then expanded or opened to form a hexagonal honeycomb core element. It is also known to use corrugated paper or metal webs either with or without smooth facing webs which are stacked and glued together, again resulting in an open core structure.

Although honeycomb-type core elements have long been proposed for use in structural panels, one reason for the lack of significant development of this use is the absence of a high speed process for making and assembling multi-layer honeycomb core elements. Also, when open core elements are made with conventional corrugated paper webs, conventional corrugating techniques and machinery are typically limited to flute sizes that are unnecessarily small for making open core elements for use in structural members. The inability to control thickness as well as the width of the expanded core material has been a problem.

SUMMARY OF THE INVENTION

The present invention comprises a fully automated and highly productive method and apparatus for the continuous manufacture of open core elements using fluted web material of various kinds and with or without intermediate smooth web materials.

In accordance with one embodiment of the present invention, an apparatus for forming large pitch fluted web uses a rigid fluted rotary roll that has flute teeth defined by adjacent tips and gullets and spaced circumferentially at the desired flute pitch. A counterroll uses parallel fluting bars that are circumferentially spaced at the flute pitch and have fluting tips that extend into the gullets of the fluting roll teeth for fluting engagement with the fluting roll. The counterroll has a rigid cylindrical core and an outer elastomer sleeve in which the fluting bars are embedded and held to permit individual fluting tips to move in response to cyclically varying force as a result of fluting tip contact with the teeth of the fluting roll. The fluting roll teeth are generally V-shaped in cross section and the tooth gullets and tips have a circular cross section and are interconnected by flat tooth flanks. The fluting tips of the counterroll fluting bars have a radius slightly less than the radius of fluting roll tooth gullets and, preferably, the radius of the fluting tips is less than the radius of the tooth gullets by an amount approximately equal to the thickness of the web being processed.

With the narrow construction of the fluting bars, contact with the fully formed web flutes occurs only in the flute gullets of the fluting roll. Correspondingly, there is no contact between the fluting roll flute tips and the flute flanks of the counterroll teeth.

The fluting roll, which is typically larger in diameter than the counterroll, has a cylindrical tubular body in which is formed a series of circumferentially spaced axial bores which may be used to supply vacuum and/or heat to the roll. The vacuum system helps bring the fluted web into full contact with the fluting roll tooth gullets and hold the fluted web in contact with the corrugating roll for continued processing. The heat which is preferably derived from steam assists in web conditioning, flute formation and setting and drying of the adhesive.

In a preferred embodiment of the present invention, the method and apparatus for forming a large pitch fluted web, as described herein, is applied to the formation of a composite double medium, single liner fluted web using two pairs of a fluting roll and counterroll operated in tandem and with the fluted rolls in register. In accordance with the method of this embodiment, formation of the composite web includes the steps of (1) positioning a pair of fluted rolls, each of which has axially extending teeth that are defined by adjacent tips and gullets spaced circumferentially at a given pitch, with the rolls in counter-rotating closely spaced relation and the teeth in register to form a nip between the fluted rolls, (2) for each fluted roll, positioning a counterroll that has axially extending fluting bars spaced at the flute pitch, the bars having tips that extend into counter-rotating engagement with the gullets of the fluted roll to form a fluting nip, (3) directing a web into each fluting nip to form a fluted medium web, (4) retaining the fluted mediums on their respective fluted rolls, (5) applying an adhesive to the tips of each fluted medium web while the web is retained on the fluted rolls, (6) bringing a liner web into contact with one of the fluted medium webs on its fluted roll, and (7) bringing the liner web into contact with the other fluted medium web in the nip formed by the fluted rolls to form the composite double medium, single liner fluted web.

The foregoing method may be advantageously applied to form small light weight packing elements by performing the additional steps of (1) using paper for the webs, (2) slitting the composite paper web in the direction of web travel into narrow parallel strips, and (3) cutting the strips into short length pieces on lateral cut lines in the gullets of the medium webs. Preferably, the cutting step comprises die cutting.

The method of forming a composite double medium, single liner fluted web, described above, may also include the steps of (1) heating the fluted rolls, and (2) applying a vacuum to the gullets of the fluted rolls along circumferential portions of said rolls on which the fluted medium webs are carried. The method may also include the step of embedding the ends of the fluting bars opposite the tips in an elastomer layer that is formed on the outer surface of the counterroll. The method may further include the step of retaining the composite web on one of the fluted rolls downstream of the nip.

Another embodiment of the present invention comprises an alternate method for the manufacture of open core elements. The method comprises the steps of (1) forming two composite web halves, each comprising a smooth web and a fluted web, (2) orienting the composite web halves with the exposed fluted web flutes facing up, (3) applying an adhesive to the exposed flute tips of one web half, (4) adhering the other web half by its smooth web to the glued flute tips of said one web half to form an open face double wall web, (5) slitting the open face double wall web longitudinally to form a plurality of adjacent equal width open face double wall strips, (6) applying an adhesive to the exposed flute tips of said open face double wall strips, (7) cutting the strips transversely to a common selected length, (8) separating the strips in a lateral direction, (9) conveying each strip in the lateral direction individually and serially into a vertical stacker, (10) dropping each strip vertically in the stacker such that each strip, after the lead strip, is deposited on the glued flute tips of the preceding strip to form an intermediate open core block of strips, (11) upending the intermediate block onto a lateral block edge to orient the exposed glued flute tips of the last deposited strip to face in the lateral downstream direction, and (12) conveying the intermediate block in the lateral downstream direction to bring the exposed glued flute tips into bonding contact with the exposed smooth web face of a preceding intermediate block to form the open core element.

The foregoing method preferably includes, prior to the step of adhering one web half to the other web half, the step of aligning the flute tips of the web halves tip-to-tip.

BRIEF DESCRIPTION OF THE DRAWINGS

FIG. 22 is a perspective view of a small packing piece cut from the composite double medium, single liner fluted web shown in FIG. 21.

FIG. 23 is a perspective view of a modified apparatus for making open core elements.

FIG. 24 is a plan view showing the application of the core elements made in the FIG. 23 apparatus to make an open core panel.

DETAILED DESCRIPTION OF THE PREFERRED EMBODIMENTS

Figure 1:
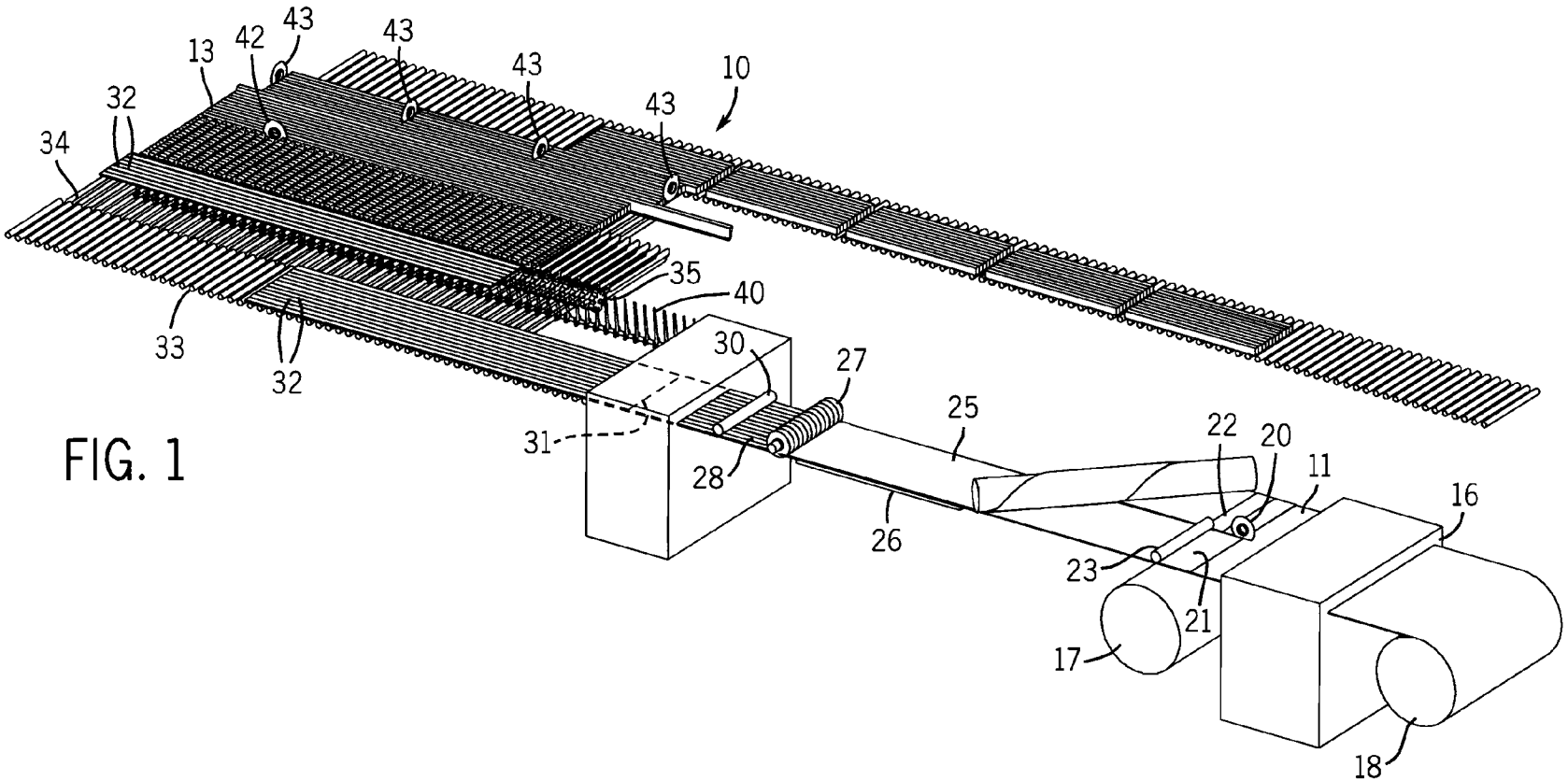
FIG. 1 is a perspective view of a system for the continuous manufacture of open core elements utilizing one embodiment of the method of the present invention.
Figure 2:
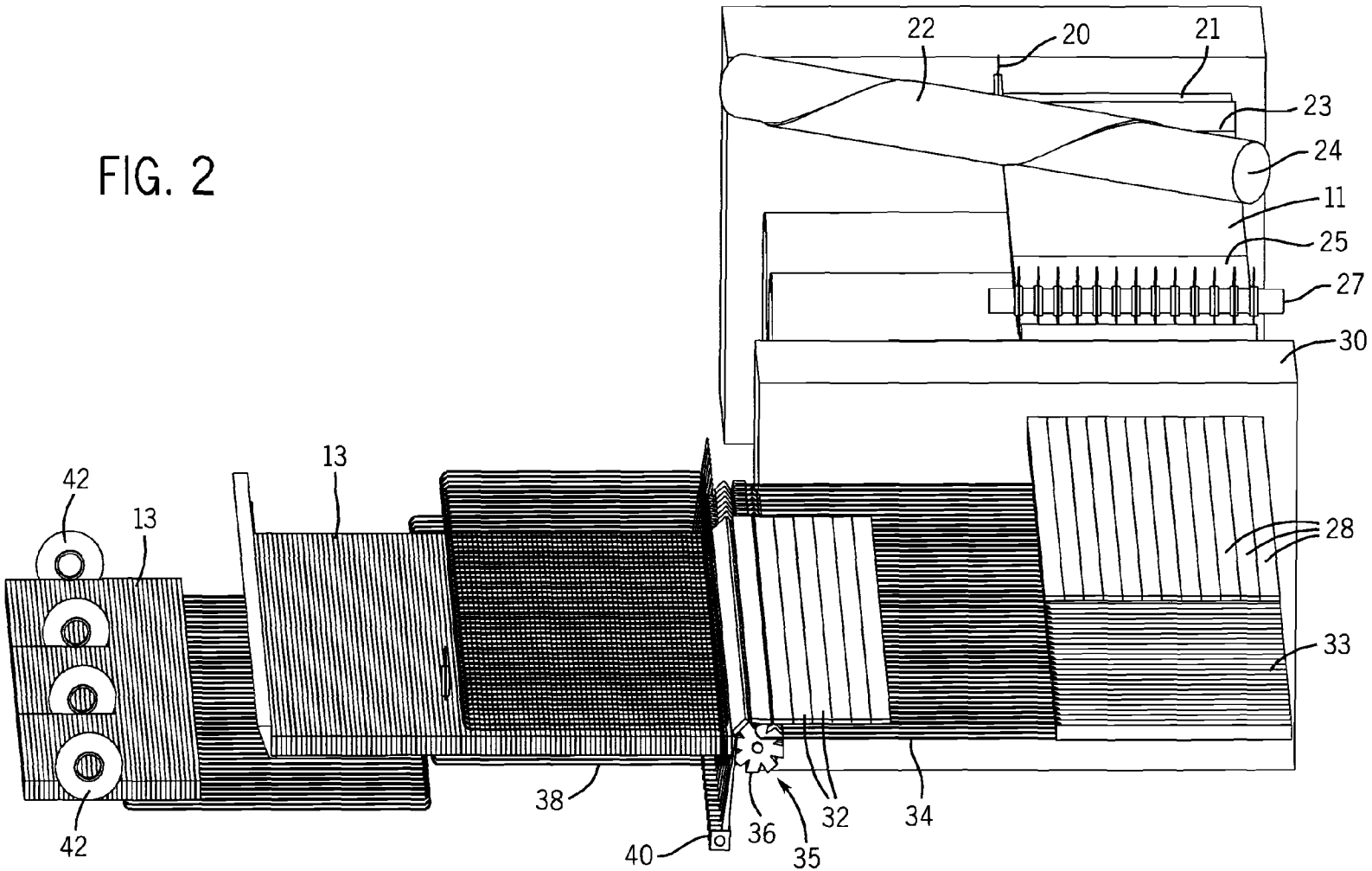
FIG. 2 is a top plan view of the system shown in FIG. 1.
Figure 3:
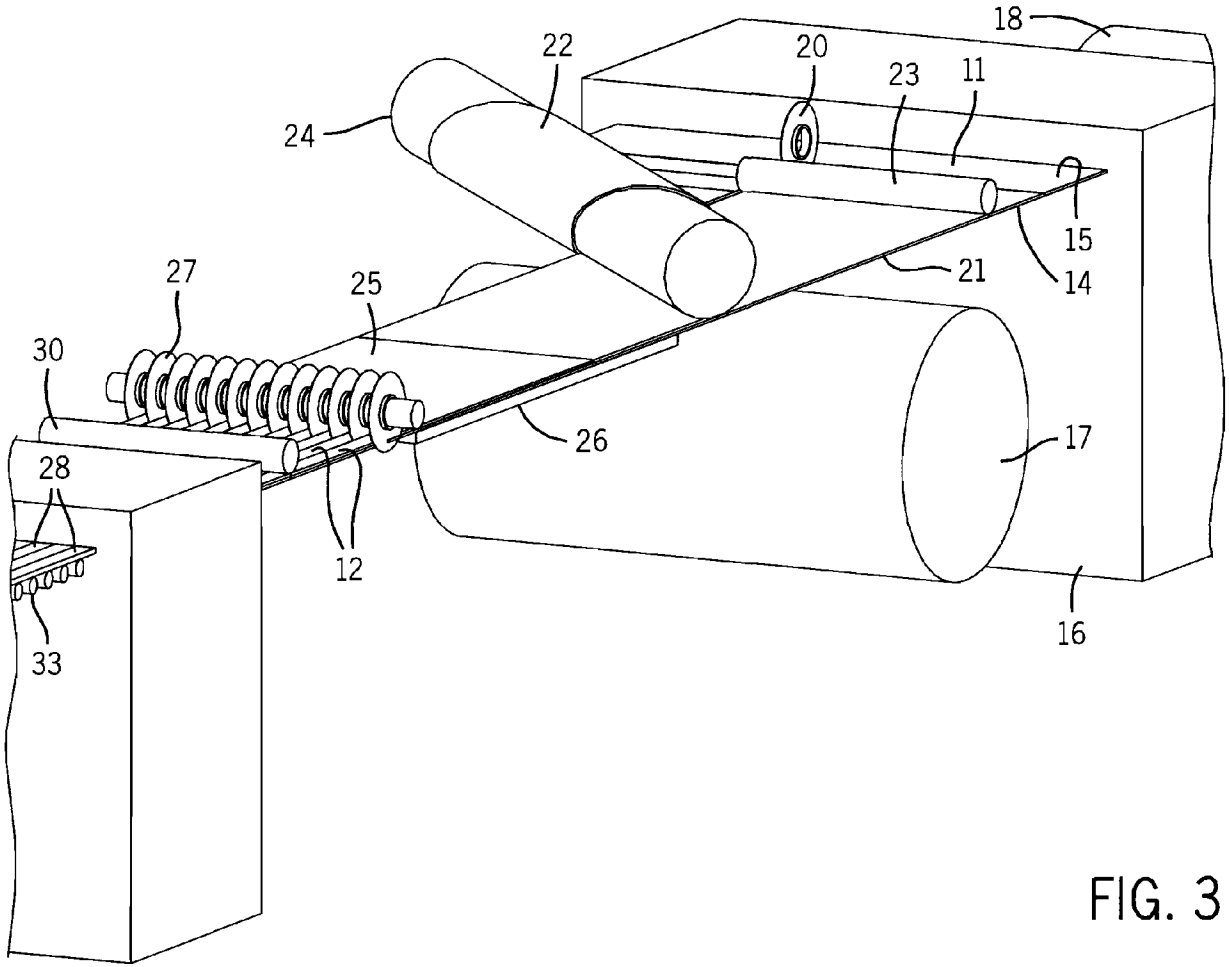
FIG. 3 is a perspective view of an upstream portion of the FIG. 1 system showing one embodiment of an apparatus for forming the composite web.

Referring initially to FIGS. 1 and 3, a core element lay up system 10 utilizes core element components made from a composite web 11 which is converted to form strip like elements (28) which are, in turn, joined to form a core element 13. In the embodiment of the invention shown, a double width composite web 11 is formed by joining a smooth web 14 and a fluted web 15 utilizing any of a number of prior art techniques. For example, the webs 14 and 15 could be formed and glued together in a single facer 16 in a manner well known in the corrugating industry. A smooth web from a supply roll 17 is fluted under heat and pressure in the single facer 16, glue is applied to the flute tips on one side of the fluted web 15, and the fluted web is then joined to the smooth web 14 from the supply roll 18.

The composite web 11 is formed (or reoriented after forming) with the fluted web component 15 facing upwardly. As the composite web 11 exits the single facer 16, it is slit longitudinally on its centerline by a slitting blade 20 to form two web halves 21 and 22. A suitable glue or adhesive is applied to the flute tips of the lower web half 21 by a glue roll 23. The other web half 21 is directed onto an angled turning bar 24 around which it is wrapped and displaced laterally to bring it into contact with the glued web half 21 where the smooth web face of the web half 22 is laid onto the glued flute tips of the other web half 21 to form an open face double wall web 25. The double wall web 25 is directed over a heating plate 26 or other heating device to cure the adhesive and permanently join the two web halves 21 and 22. As will be described in greater detail below with respect to the presently preferred embodiment, the flutes of the two component webs forming the open face double wall web 25 are brought together and joined so that the flutes of the two component webs are in flute tip-to-flue tip alignment.

The open face double wall web 25 is then slit longitudinally with a multi-blade slitter 27 to form a plurality of equal width open face double wall strips 28. The open face double wall web 25 has an upper exposed fluted face and, therefore, the strips 28 also have laterally extending flutes. The strips then pass beneath a second glue roll 30 which applies a suitable adhesive to the exposed flute tips. When the plurality of strips 28 reaches a selected length in the machine direction, a cut-off knife 31 downstream of the glue roll cuts the strips 28 to a common length. The strips are preferably cut at the bottom of the next flute which will provide a core element just slightly larger than the desired length. The plurality of glued and cut strips 32 is accelerated on a transport conveyor 33 to form a gap between the strips and the next-following uncut strips.

Figure 4:
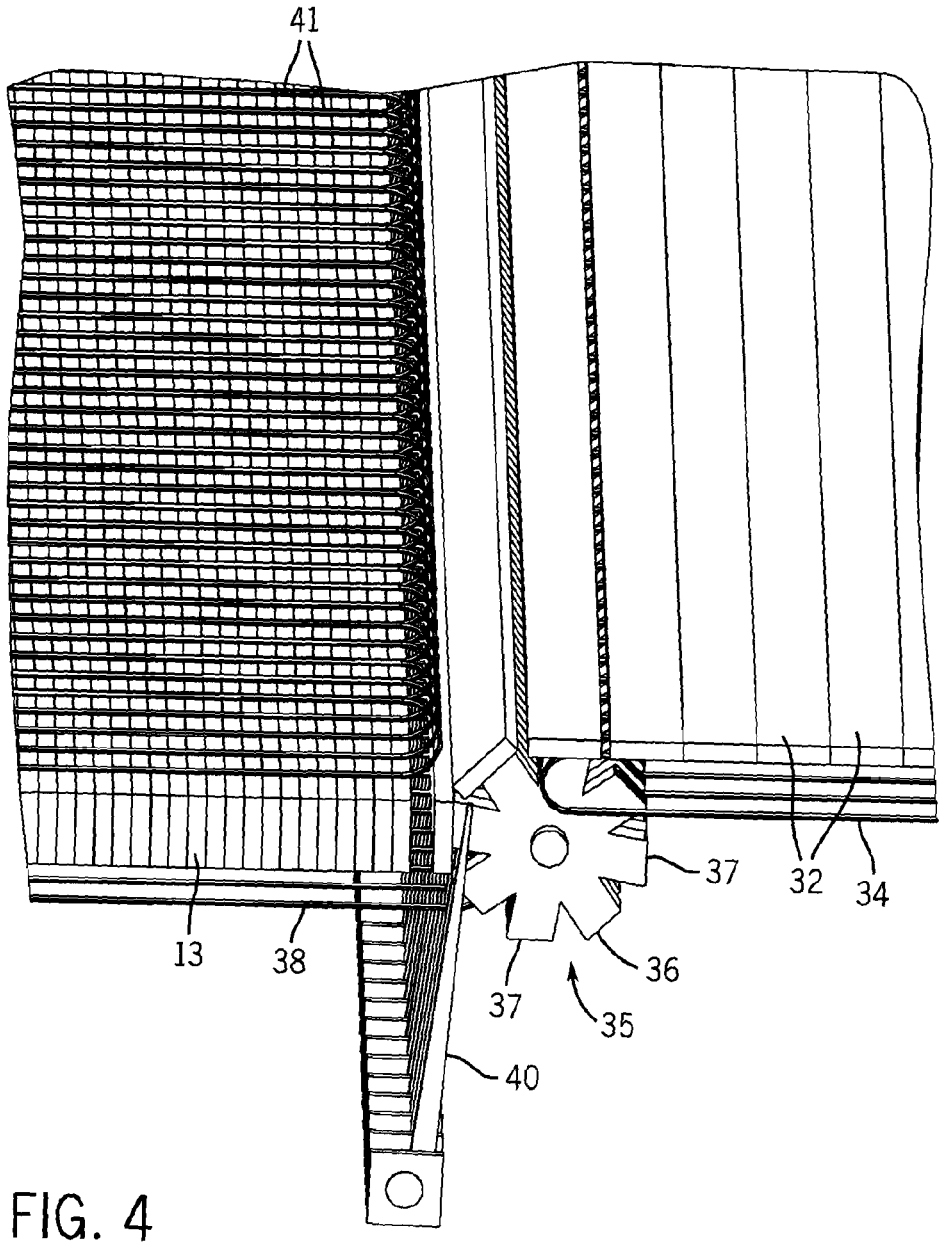
FIG. 4 is a perspective view of an intermediate downstream portion of the system showing the incremental formation of core elements.

The plurality of glued and cut strips 32 is then cross-transferred out of the machine direction path of the next following plurality of strips and onto a lateral feed conveyor 34 to a strip upender 35. As is best seen in FIG. 4, an upender roll 36 has a series of circumferentially spaced vacuum headers 37 that serially capture each glued and cut strip to reorient the strip from a horizontal to a vertical position such that succeeding strips are deposited on common lateral strip edges and in face to face relation with each strip that precedes it. In this orientation, the glued flutes of each strip face the smooth web face of the preceding strip and, when deposited on the element forming conveyor 38, are brought into adhesive contact. As can be seen in FIG. 4, the flutes on the strips extend vertically and together comprise a core element 13. To facilitate removal of each strip 28 from the vacuum header 37 on the upender roll 36, each vacuum header includes a series of laterally spaced vacuum ports between which the tines of a discharge fork 40 extend. The fork is operable to engage the unglued smooth face of each strip and push it into contact with the preceding strip on the element forming conveyor as the vacuum is released. The discharge fork is then returned to its discharge position for the next following strip.

In this embodiment, as the core element 13 is being formed, a set of conveyor belts 41, positioned over the top of the core element, applies a normal force to assist in compacting the core element and press the glued flute tips of each strip to the smooth face of the preceding strip by running slightly faster than the advancing core block which is held back by downstream holding rolls.

Figure 5:
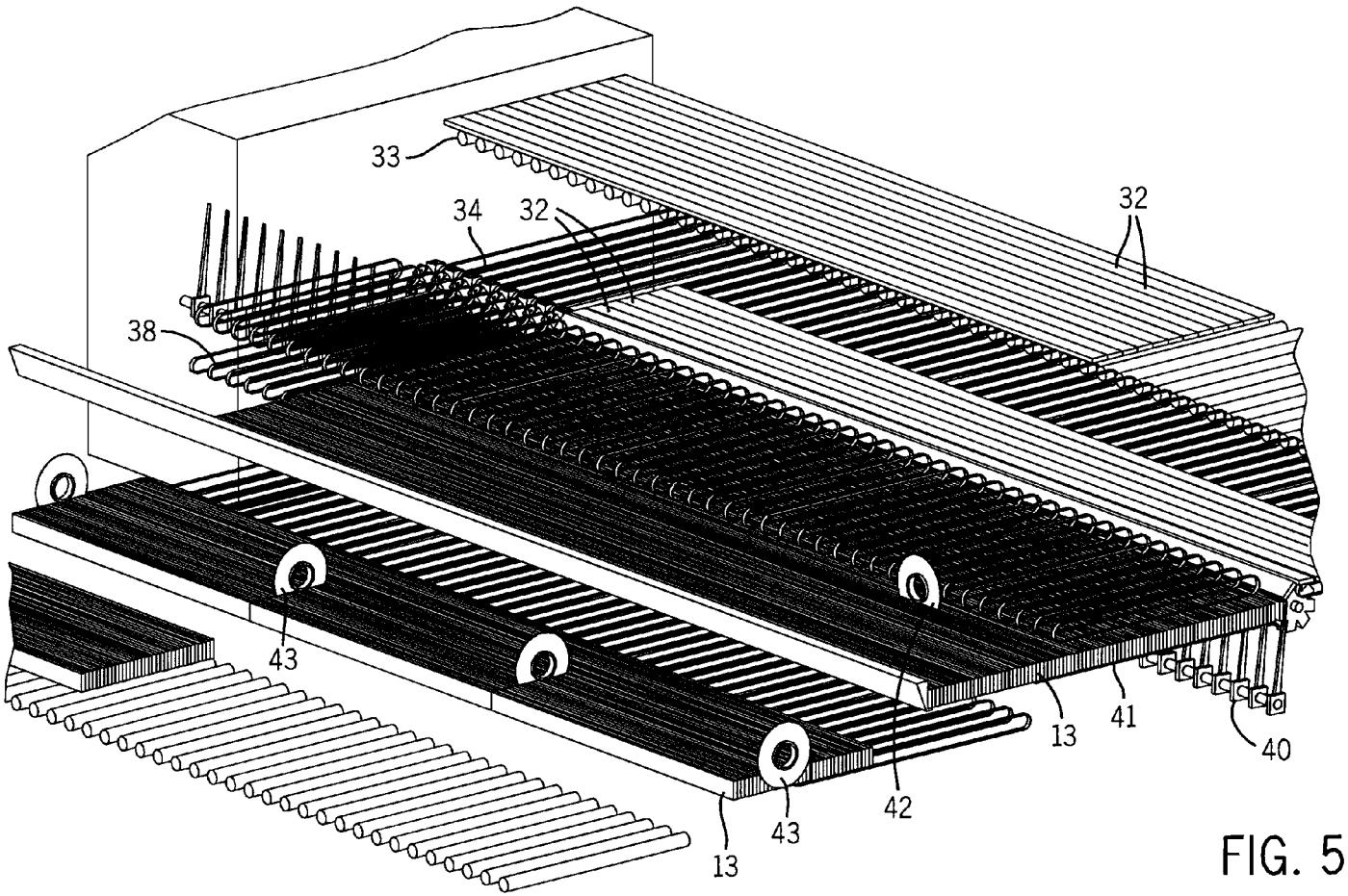
FIG. 5 is a perspective view of the downstream portion of the system shown in FIG. 1.

When a core element 13 comprising a desired number of strips has been formed, the core element 13 is accelerated into a trim and cut station where it can be cut into any number of smaller core elements. In the example shown in FIG. 5, the large formed core element 13 is trimmed longitudinally (in the longitudinal direction of the strips 28) with a trim blade 42 to a selected edge dimension. The trimmed element 13 is then moved to a cutting position where a series of cutting blades 43, including an edge trim blade, cuts the long core element into final element sizes. For example, if the final core elements are to be used in the manufacture of hollow-core doors, the strips 28 could be cut to lengths of 240", upended and stacked to a core width of 30" and finally trimmed and cut to provide three door pieces each 80"×30".

The height or thickness of the core element 13 depends on the width to which the strips 28 are slit. The length of the core element 13 can be varied as desired. Thus, the system has the capability of continuously and rapidly forming core elements of widely varying dimensions.

Composite fluted webs, useful in forming core elements, can be made in a number of different ways, can utilize different kinds of web materials, and the fluted web can be formed in various ways. As indicated above, it is preferable to utilize a flute size for the fluted web that is larger than flutes commonly made on a typical single facer. A larger flute size will provide adequate strength for the core element, but utilize significantly less paper or other web material in the formation of the fluted web.

Figure 6:
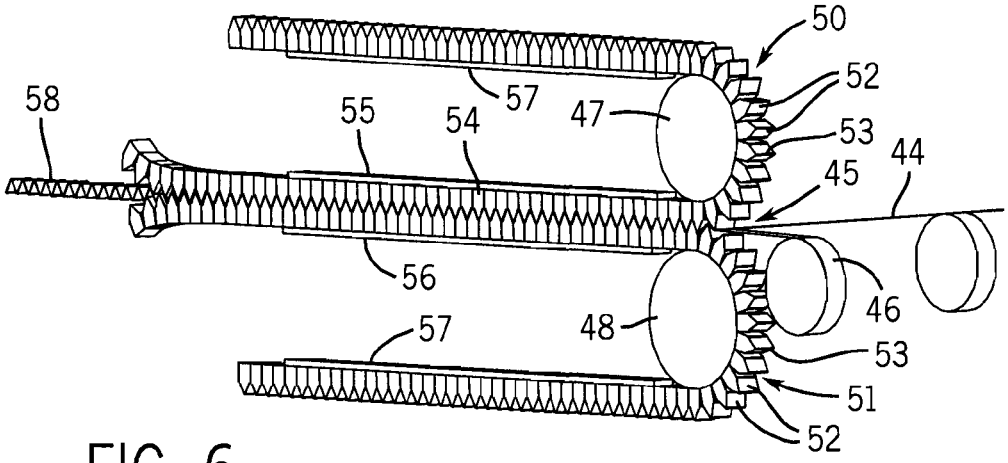
FIG. 6 is a perspective view of an apparatus for forming an all-fluted composite web.

Referring to FIG. 6, an alternate apparatus utilizing an alternate flute forming method is shown. In the embodiment shown, a composite web is made by simultaneously fluting two incoming webs which may be made of the same or different materials. If, for example, two paper webs are utilized, an upper web 44 has a layer of glue, such as a starch adhesive, applied to its lower face upstream of a fluting nip 45. A lower web 46 is also fed with the glued upper web 44 into the nip 45 formed at the upper and lower tail sprockets 47 and 48 carrying a pair of intermeshing fluting conveyors 50 and 51. Each of the fluting conveyors 50 or 51 includes a continuous series of fluting bars 52 made, for example, from aluminum extrusions and extending the full width of the incoming webs 44 and 46 (e.g. 96" or about 2440 mm). The fluting bars may be carried on a series of laterally spaced ¾" pitch roller chains with the fluting bars 52 attached thereto with conventional K-1 attachments. The roller chains may, for example, be laterally spaced 16" or about 406 mm apart. Each fluting bar has an exposed flute forming tip 53 that is shaped to form a flute one 12" (about 13 mm) deep and with a pitch of ¾" (about 19 mm) corresponding to the pitch of the carrying roller chains.

As the webs 44 and 46 come into the fluting nip 45, they are simultaneously fluted, one flute at a time, and joined by the adhesive previously applied to the contacting face of one of the webs. The joined webs are held together in a straight fluting run 54 of the fluting conveyors 50 and 51 to which heat is applied by upper and lower heating elements 50 and 51 to bond and cure the adhesive. Each of the fluting conveyors 50 and 51 may include flute pre-heaters 57 to help maintain the temperature of the fluting bars 52. A composite fluted web 58 exits the fluting conveyors 50 and 51 at their head ends where, preferably, the conveyor flights are separated gradually on a much larger radius arc than that of the tail sprockets 47 and 48. The resulting composite fluted web 58 is substantially cured and rigid enough for further processing with or without the addition of a smooth facing web.

A composite fluted web 58 of the foregoing type could, for example, be glued to a smooth web and the web processed to form core elements in the manner previously described. However, the composite fluted web 58 also has utility for other applications, such as a substitute for the ubiquitous styrofoam peanuts used as packaging filler and cushioning material.

Figure 7:
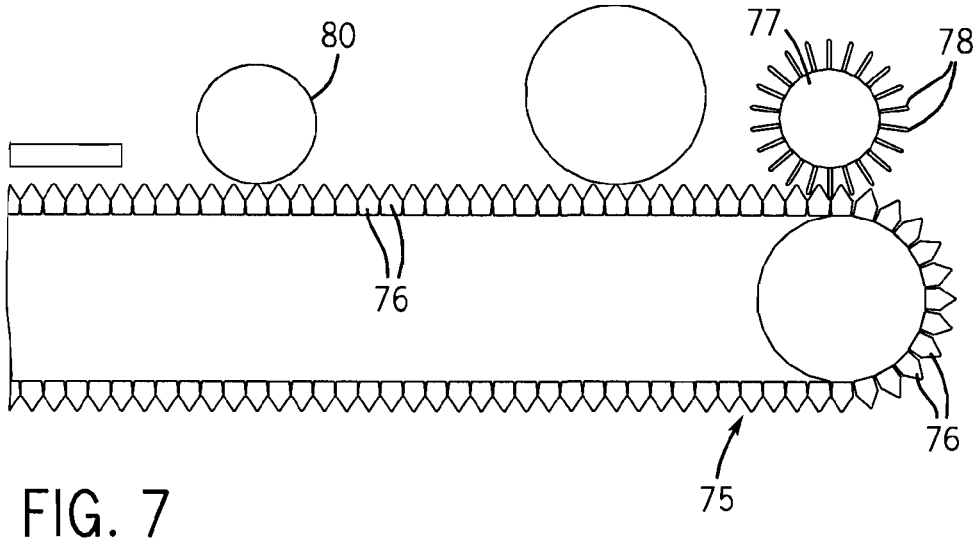
FIG. 7 is a side elevation detail of an alternate flute forming apparatus of a presently preferred construction.
Figure 8:
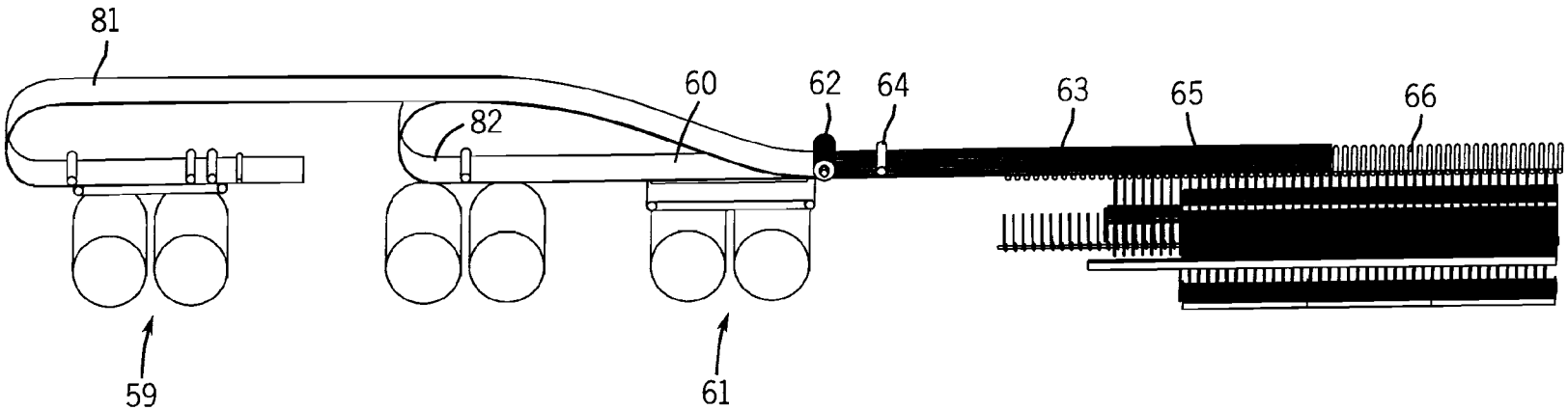
FIG. 8 is a perspective view of an alternate system for the manufacture of open core elements.
Figure 9:
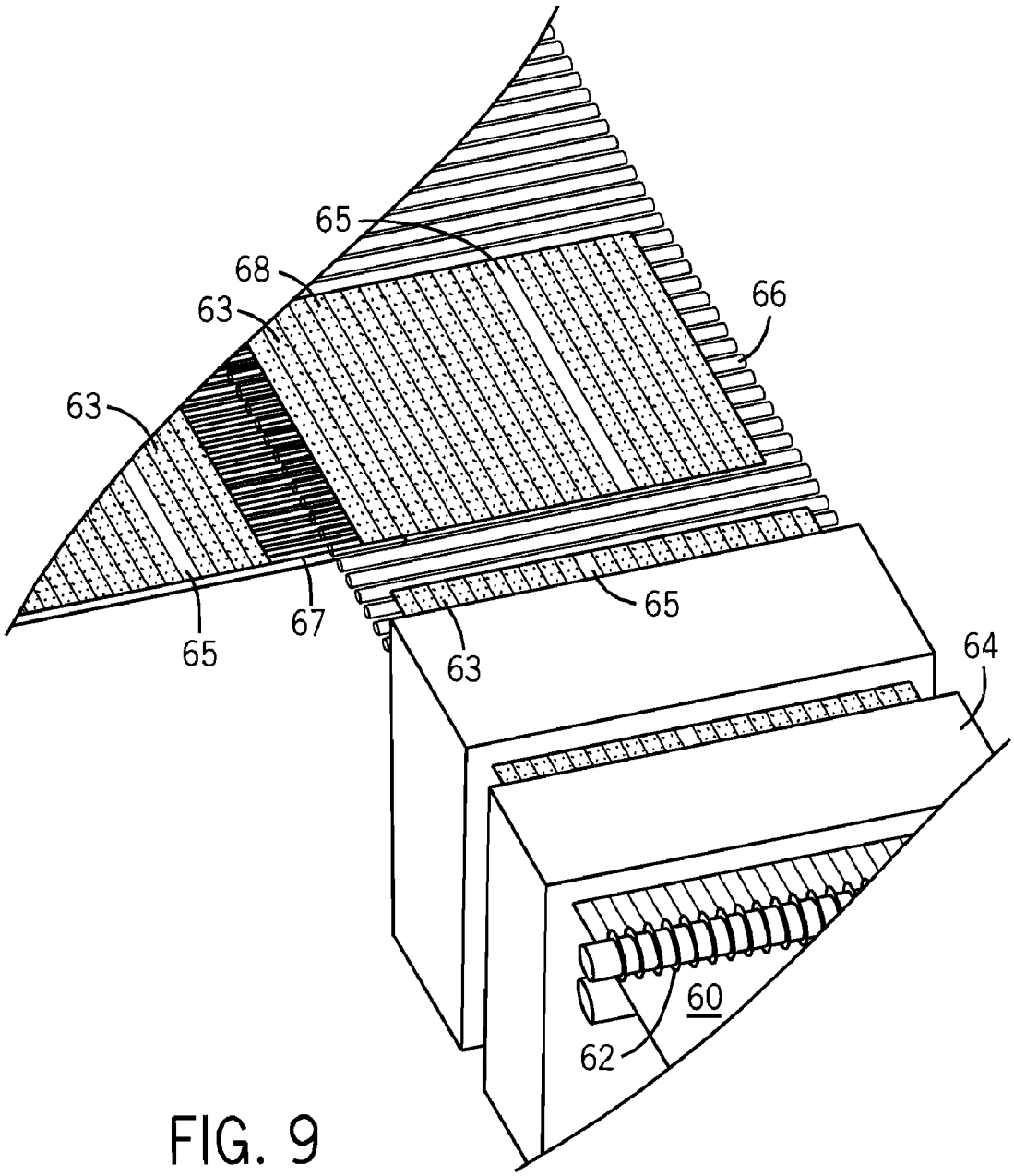
FIG. 9 is a perspective detail of a portion of the system shown in FIG. 8.
Figure 10:
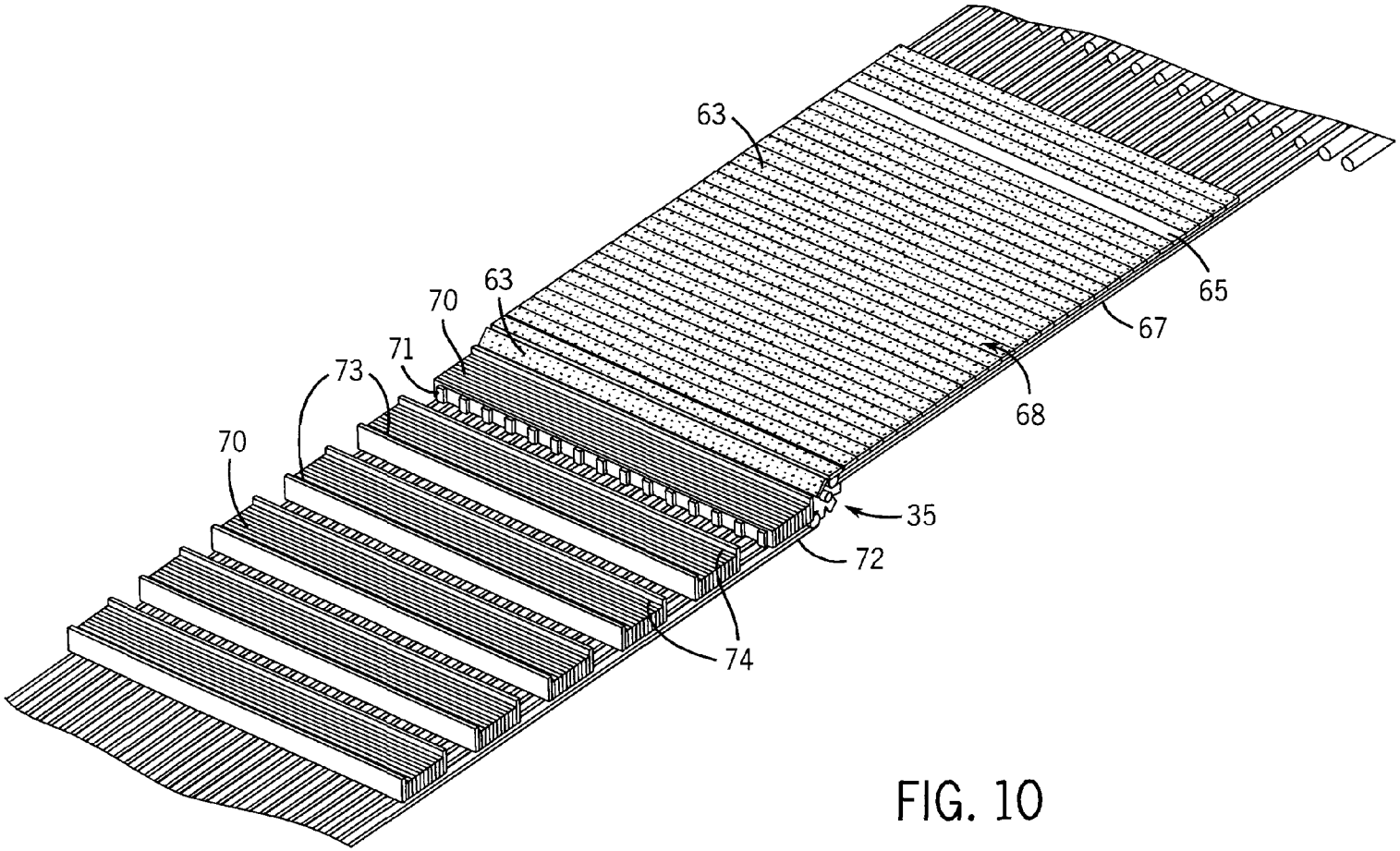
FIG. 10 is a further perspective detail of the system shown in FIG. 8.
Figure 11:
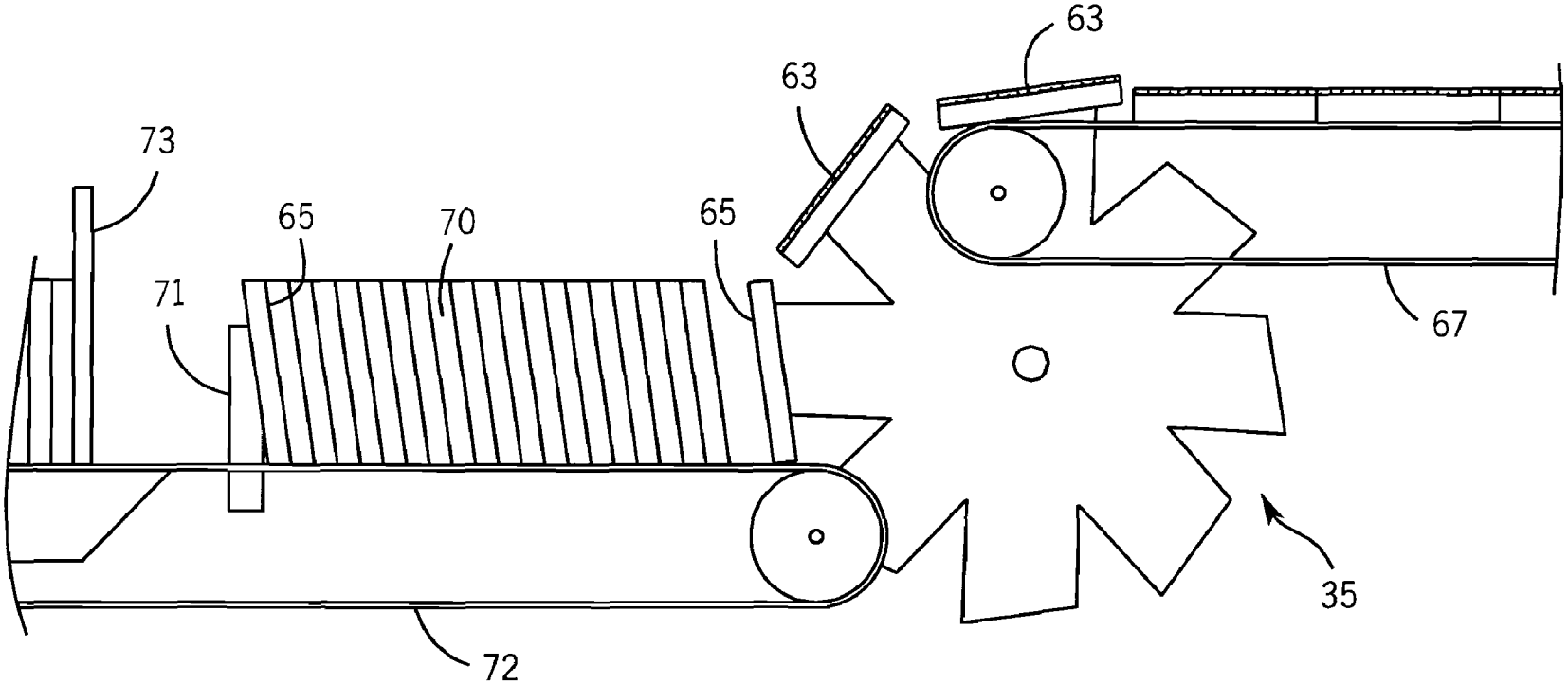
FIG. 11 is a side elevation detail of a preferred embodiment of an upender used in the method of the present invention.

An alternate apparatus for forming a fluted web is shown schematically in FIG. 7. In this embodiment, a lower fluting conveyor 75 is similar to the fluting conveyor 51 of the FIG. 6 embodiment. The flute bars 76 are heated and, in addition, are provided with a vacuum system enabling the formed flutes to be drawn into the valleys between the flute bars. In lieu of an upper fluting conveyor, a spoked fluting roll 77 is used. The fluting roll is provided with a plurality of circumferentially spaced spokes 78 which press the incoming web one flute at a time into the fluting conveyor 75 where the applied vacuum holds the web in position. If two webs of paper or other materials are joined as described with respect to the FIG. 6 embodiment, the vacuum and heat applied to the web downstream of the fluting roll 77 will cure the composite web resulting in a composite fluted web cured and rigid enough for further processing the exposed flutes of the upper web may have an adhesive applied by a downstream glue roll 80 for the addition of a smooth facing web.

Although a single wall composite web, having one fluted web and one smooth web, can be utilized in the overall process of the present invention, it is preferable to use an open face double wall web such as web 25 used in the process described with respect to FIGS. 1-5. In that process, a full width single face web is slit on its center line and one of the slit halves is turned and moved laterally on a turning bar to be joined with the other web half. However, an open face double wall web may also be formed by joining two full width single face webs each formed on a separate single facer, as will be described in the following preferred embodiment. Regardless of how an open face double wall web is formed, it is important in order to maximize the strength of the core elements to be formed to align the flutes in the joined single face webs so that they are in alignment flute tip-to-flute tip in the double wall web. On the other hand, if a more springy cushioning effect is desired in a core element, the flutes in the two component single face webs may be aligned one half pitch from flute-to-flute alignment or such that the flutes of one composite single face web align with the valleys of the other composite single face web.

Another embodiment of a system for carrying out the process for the continuous manufacture of open core elements is shown in FIGS. 8-11. The incoming web 60 from the upstream single facer or single facers 59 and 61 may be open face single wall or open face double wall, the later being either full width or half width. Preferably, however, for the reasons stated above, the incoming web 60 is an open face double wall web. A pair of single facers 59 and 61 (or fluted web forming apparatus of FIG. 6 or 7) provide an upper fluted single face web 81 (see the FIG. 12 detail) with its smooth web on the bottom and is joined to a lower fluted single face web 82 (FIG. 12 detail) to the exposed flute tips of which an adhesive has been applied with a glue roll 83. The resulting composite open face double wall web 60 (see the FIG. 13 detail) is heated and cured and brought into the lay-up portion of the system for further processing.

The web 60 is slit in a multi-blade slitting knife 62 into open face double wall strips 63 with the flutes oriented upwardly. As with the previously described process and methods, the width of the strips 63 determines the height or thickness of the finished open core elements. The strips 63 move from the slitting knife under a glue roll 64 where glue is applied to the exposed flute tips. However, in this embodiment one strip is left unglued. The unglued strip 65 may be provided in a number of ways, such as using a laterally movable scraper blade operatively engaging the glue roll to prevent glue from being applied to the unglued strip 65. Successive unglued strips 65 are placed among the strips exiting the glue roll to space between them a selected number of glued strips 63 desired in the finally formed core element. Thus, the unglued strips 65 may not always be in the same lateral position on the strips exiting the glue roll 64 because the desired core element may utilize more or less than the total number strips 63 slit from the incoming web 60.

Each group of strips 63 exiting the glue roll is accelerated on a speed-up conveyor 66 to separate the strips from the next incoming group of strips. The strip group 68 is then cross-transferred onto a lateral feed conveyor 67 where each of the strips now extends laterally across the feed conveyor 67. At the downstream end of the lateral feed conveyor 67, a strip upender 35 identical to the one described with respect to the preceding embodiment, operates to sequentially reorient each strip 63 from a horizontal to a vertical position. Each reoriented strip is positioned with its glued flute tips extending vertically and facing in the downstream direction and is brought into contact with the smooth web on the back of the preceding strip 63.

Referring to FIGS. 8-11, each unglued strip 65 forms the lead strip of a hollow core element 70 (see the FIG. 14 detail) of a desired size. The unglued lead strip 65, after it is upended, is brought into contact with a toothed gate 71 operating between the strip upender 35 and the upstream end of an element forming conveyor 72. When a hollow core element 70 is formed, the toothed gate 71 is retracted and the element 72 moves into contact with a downstream compactor plate 73 on the element forming conveyor 72. As the elements 72 move downstream, an upstream compactor plate 74 moves into contact with the smooth web face of the upstream most stream 63 in the formed element 70. Because the downstream compactor plate 73 engages an unglued strip 65 and the upstream compactor plate 74 engages the smooth web face of the last strip which carries no glue, the problem of a strip adhering to the toothed gate 71 or one of the compactor plates 73 or 74 is minimized.

Instead of utilizing an unglued strip 65, it is also possible to insert an unglued sheet of paper 84 which adheres to the glued flute tips of the facing strip and becomes part of the core element 70. Alternately, the face of the downstream compactor plate 73, in the previously described embodiment, may be coated with a non-stick material.

In an alternate method for compacting the formed core elements 70, the element forming conveyor 72 may be angled downwardly to utilize the force of gravity to help press the strips 63 together. In addition, a weighted plate may be inserted against the smooth web face of the rearmost strip of the core element 70.

Figure 15:
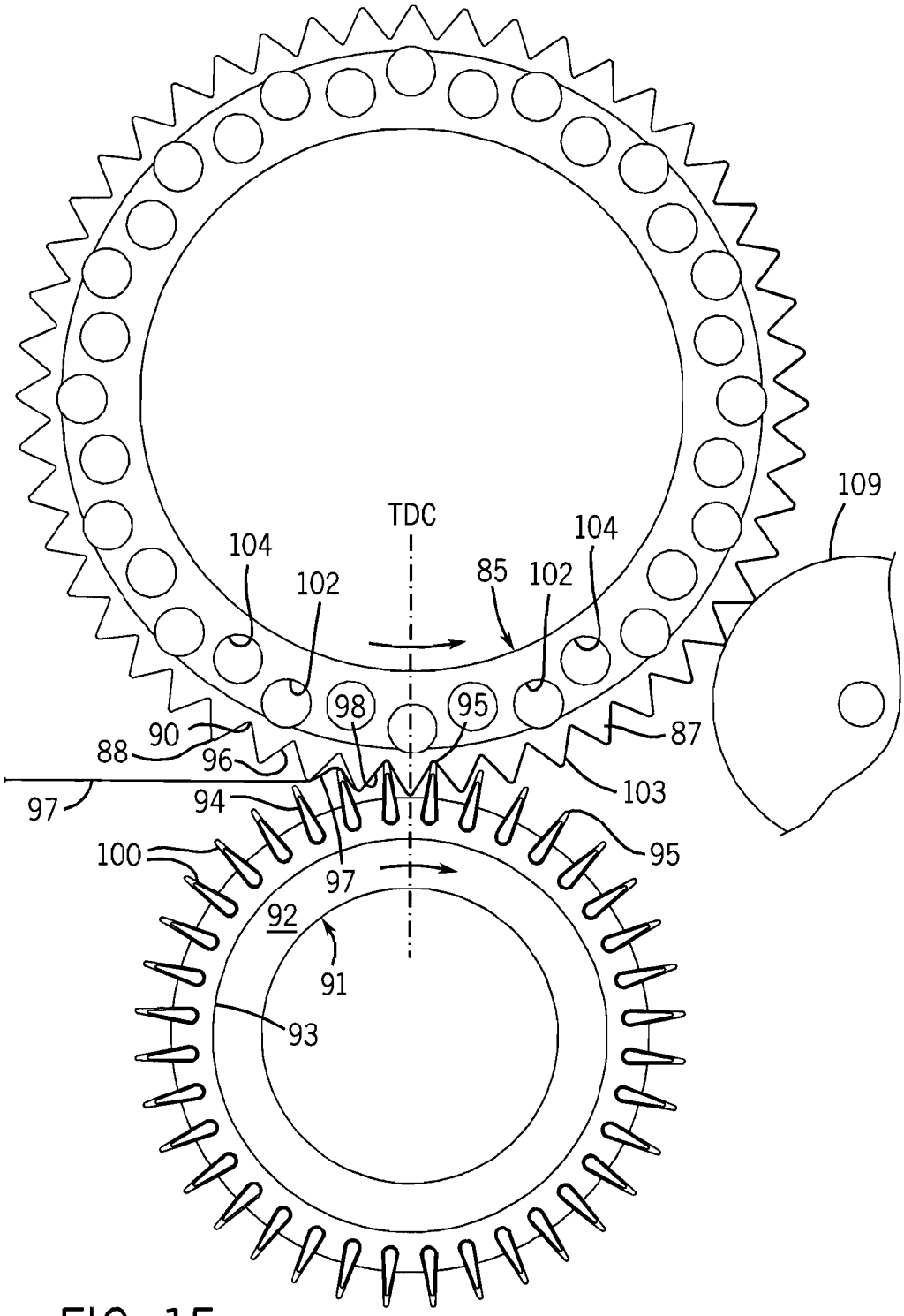
FIG. 15 is an end view of the web fluting apparatus of a presently preferred embodiment.
Figure 16:
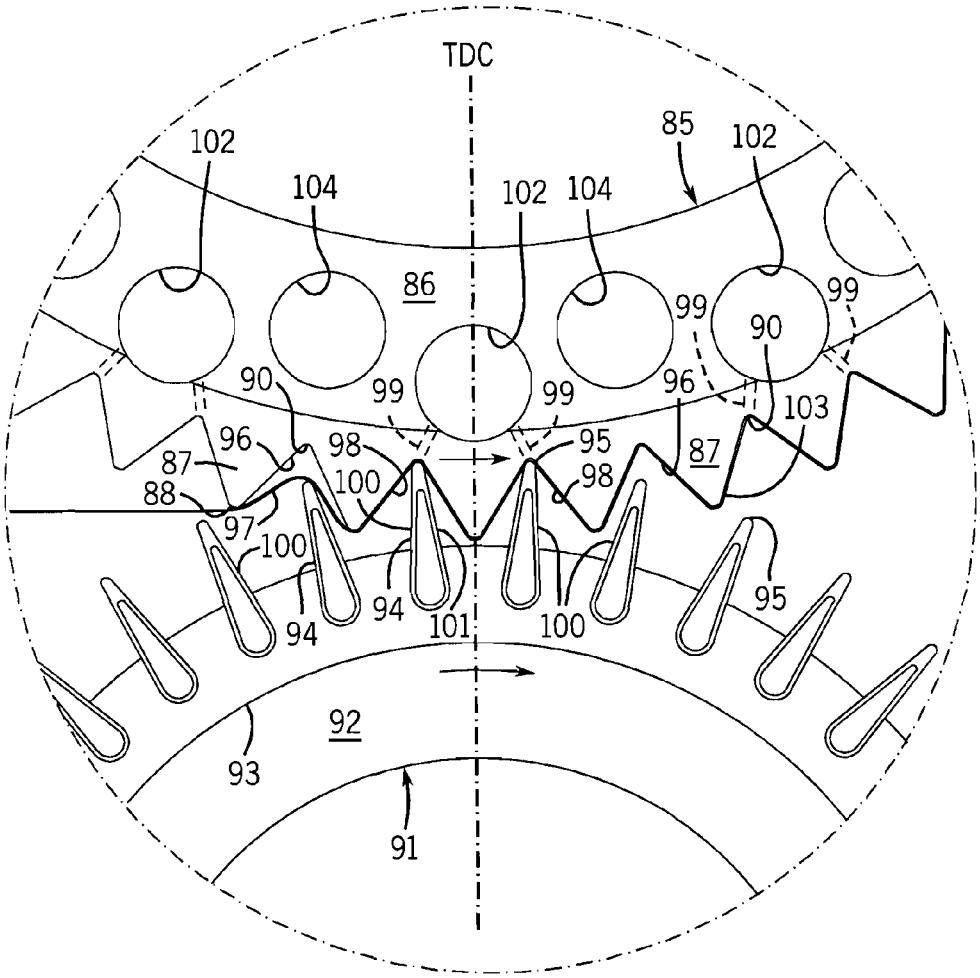
FIG. 16 is an enlarged view of a portion of FIG. 15.
Figure 17:
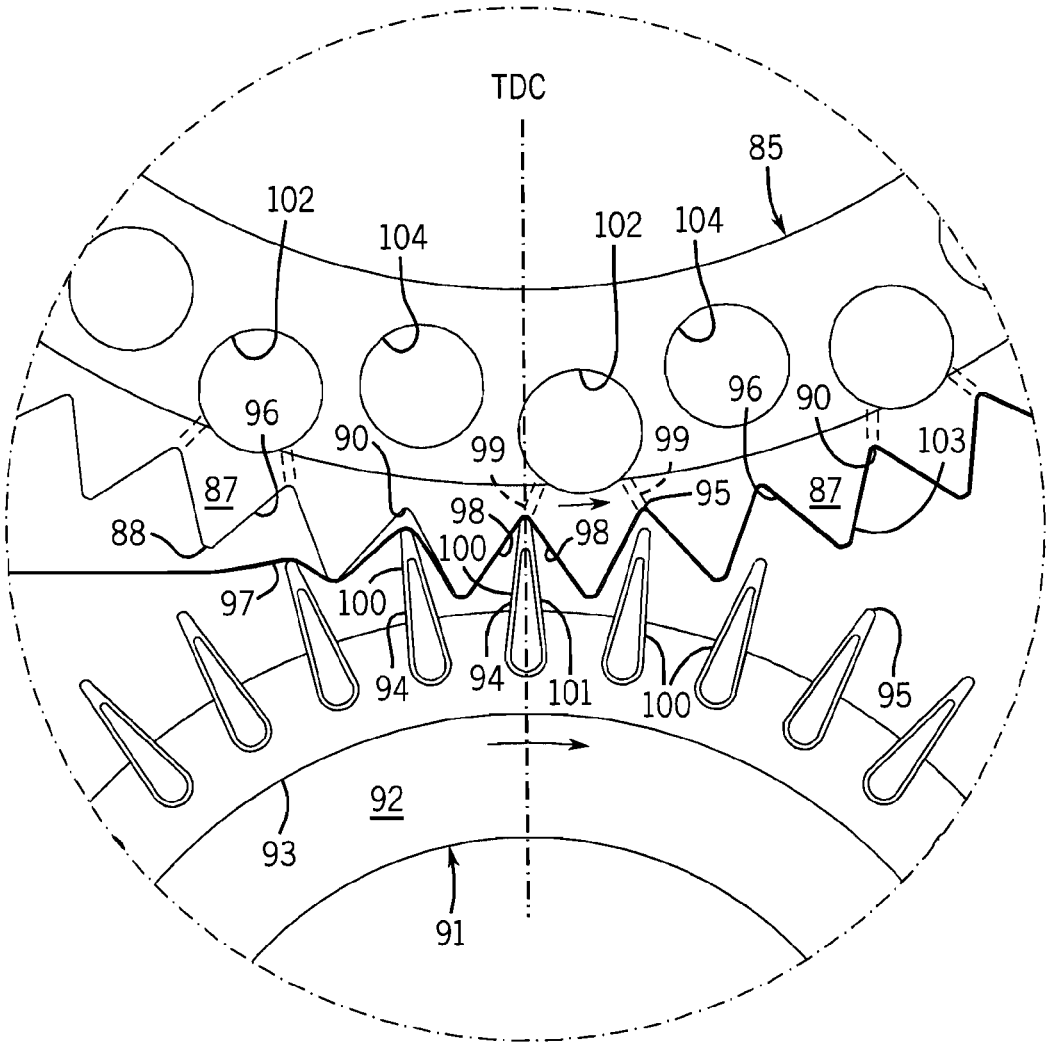
FIG. 17 is a view similar to FIG. 16 showing the fluting progression of the interacting fluting rolls.

In a presently preferred apparatus for forming flutes in a continuous web, reference is made to FIGS. 15-17. The apparatus includes an upper rotary fluting roll 85 made of a rigid tubular cylindrical shell 86. The fluted outer surface is defined by circumferentially spaced flute teeth 87 having adjacent tips 88 and gullets 90. The teeth 87 are spaced at a common flute pitch which, for example, for a large fluting apparatus, may be ¾" (about 19 mm). The flute tooth depth vertically from tip 88 to gullet 90 may be ½" (about 13 mm). As indicated previously, the flutes are substantially larger than typically formed in the corrugating industry for the manufacture of corrugated paperboard and the like. The fluting roll 85 may have a nominal diameter of 16" (about 406 mm).

A lower rotary counterroll 91 is mounted and positioned for counterrotational engagement with the fluting roll 85. Typically, the upper fluting roll 85 is the driving roll and the counterroll 91 is the driven roll. The nominal diameter of the counterroll 91 may be 8" (about 203 mm). The counterroll 91 also has a rigid cylindrical interior shell 92, but it is covered on its exterior with an elastomer sleeve 93, preferably made of a relatively hard rubber, such as conventional die rubber. Imbedded in the elastomer sleeve 93 are a plurality of circumferentially spaced fluting bars 94 having round outer tips 95 circumferentially spaced at the pitch of the fluting roll 85. As may be seen in the drawings, the fluting bars 94 have a sort of tear drop cross sectional shape and are preferably made from hollow aluminum extrusions. The fluting bars 94 and the flute teeth 87 of the fluting roll 85 extend axially together and parallel to one another the full width of the rolls 85 and 91, which conveniently may be 96" (about 245 cm). However, axial roll length is not critical and the rolls may be made with any length suited to the web material on which they operate.

The flute teeth 87 of the fluting roll 85 are generally V-shaped in cross section with the gullets 90 having a circular cross section. The tips 88 also have a circular cross section. The flute teeth 87 have flat flanks 96 between the tips and gullets. It is significant in the formation of large pitch flutes in a web 97, as shown in FIGS. 16 and 17, that the fluting bars make contact with the formed web flutes 98 only in the gullets 90 of the fluting roll 85. In addition, there is no contact between the fluting roll flute tips 88 and the flanks 100 of the counterroll fluting bars 94. Thus, as may best be seen in FIG. 17, the tips 95 of the fluting bars 94 progressively engage and push the web material 97 into the gullets 90 of the fluting roll 85 with operative contact between the fluting bar tips 95 and the teeth 87 of the fluting roll only at the points of full web flute formation.

Preferably, the tips 95 of the fluting bars 94 have a radius slightly less than the radius of the flute teeth gullets 90 of the fluting roll 85. Typically, for a web 97 of a given thickness, radius of the fluting tips 95 is less than the radius of the flute teeth gullets 90 by an amount approximately equal to the web thickness, e.g. 0.009" (0.23 mm). Instead of circular cross section tips 88 and 95 on the fluting roll teeth 85 and fluting bars 94, respectively, a compound radius may be used.

The rubber sleeve 93 in which the fluting bars 94 are embedded serves two important functions, in addition to providing firm support for the bars. First, if the lower counterroll 91 were made with the fluting bars 94 rigidly attached to the steel shell 92, the vertical radial distance between the two roll centers, as the paper web 97 passes through the fluting nip, is forced to change. Without the cushioning effect provided by the rubber sleeve 93, the rigid steel rolls would be forced to deflect, resulting in high vibration and noise and, quite possibly, damage to the web. For example, using a 16– diameter fluting roll 85 and an 8" diameter counterroll 91, referring to FIGS. 16 and 17, as the fluting bar 101 that is just upstream from the top dead center position of the rolls and has the web fully engaged with the gullet 90, moves to the top dead center position (from FIG. 16 to FIG. 17), the gullet 90 and the bar tip 95 move relatively more closely together by 0.027" (0.7 mm). However, the deflection that would otherwise have to be taken up by rigid steel rolls is absorbed by the rubber sleeve 93, thereby minimizing vibration and noise, as well as possible damage to the web 97.

In addition, after the fluting bar 94 passes the top dead center position (moving from FIG. 17 to FIG. 16), the resilience of the rubber sleeve 93 pushes the tip 95 of the fluting bar radially outwardly so that it maintains contact with the fluted web in the gullet 90 until the following fluting bar makes full contact in the tooth gullet 90 with which it is associated. This provides a smooth transition from flute bar to flute bar without loss of intimate fluting contact between the fluting bar tips 95 and the fluting roll gullets 90.

Figure 20:
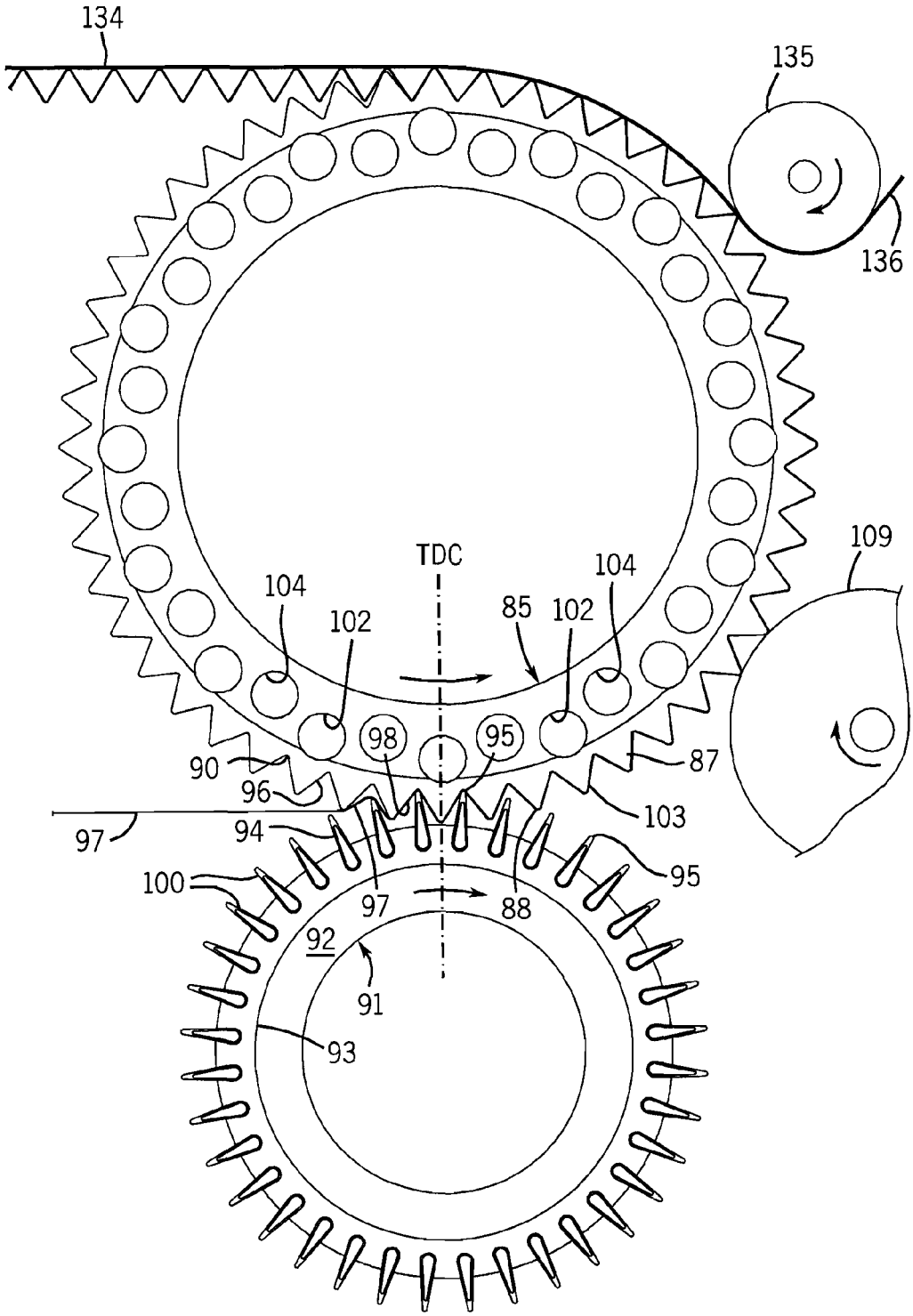
FIG. 20 is an end view of the web fluting apparatus shown in FIG. 15 used to form a single face fluted web.
Figure 21:
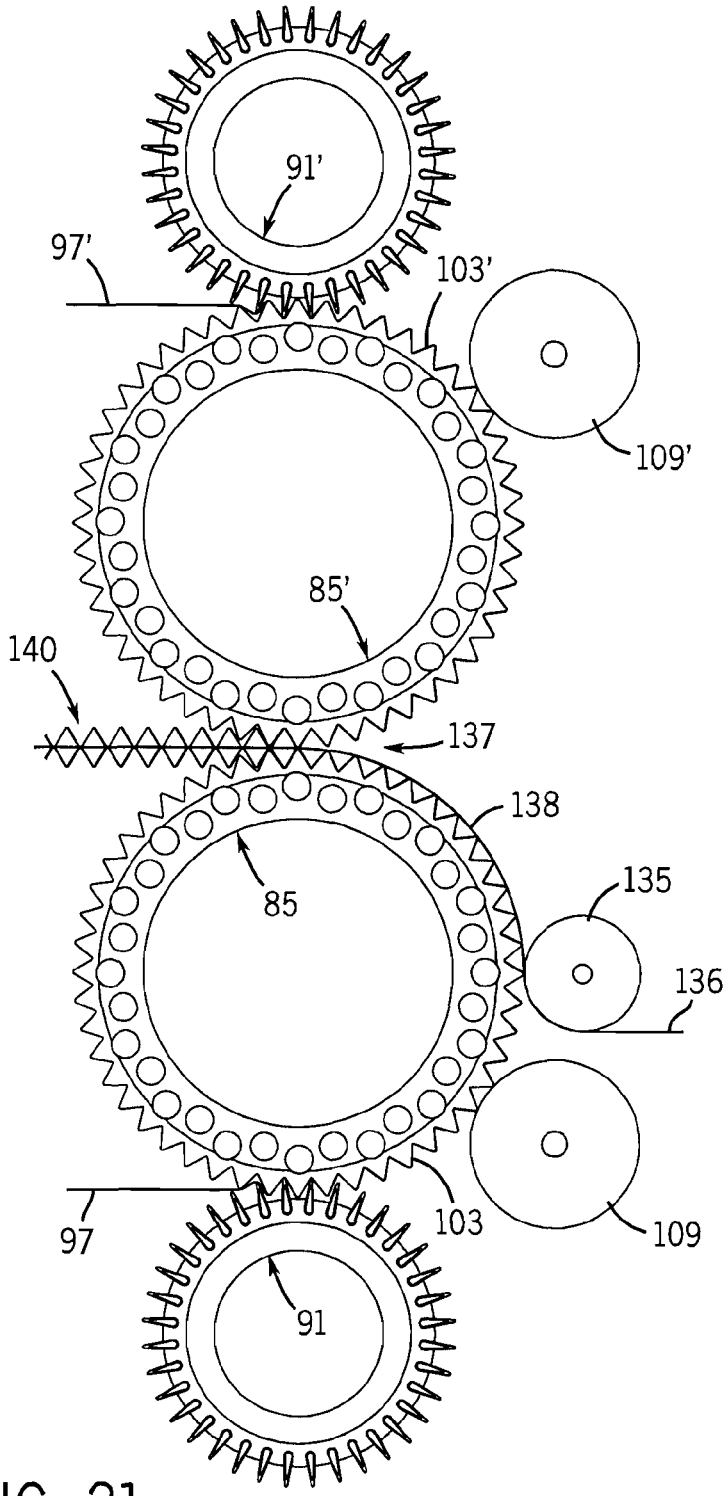
FIG. 21 is an end view of an apparatus using two pairs of the web fluting apparatus of FIG. 20 to form a composite double medium, single liner fluted web.

To assist in formation of the flutes 98, it is desirable to provide vacuum to the gullets 90 of the upper roll flute teeth 87. Vacuum is supplied through a series of circumferentially spaced, axially extending vacuum bores 102 in the fluting roll shell 86. With appropriate internal valving, the vacuum is preferably applied at the point of flute formation and to help retain the formed web in contact with the roll, as shown in FIGS. 16 and 17. After the fluted web 103 moves out of the fluting nip between the rolls 85 and 91, a glue roll 109 may be used to apply an adhesive to the web which is subsequently joined downstream to a liner web, as shown in FIGS. 20 and 21.

It may also be desirable to heat the fluting roll 85 by supplying steam to a circumferentially spaced, axially extending series of steam bores 104 formed in the fluting roll shell 86. As shown, the steam bores 104 alternate circumferentially with the vacuum bores 102. However, any convenient arrangement may be used. The heat applied to the roll 85 and the web 97 helps precondition the fluted web for downstream application of an adhesive, such as a starch-based glue, to the flute tips of the fluted web 103, as will be described in more detail below. The heat also enhances the progress of the starch-based glue into the green bond stage, as is known in the art.

Because in some applications it may be desirable to waterproof a paper web 97, the heated fluting roll 85 may assist in drying a liquid adhesive applied to the web 97 before fluting. For example, if an A-phase phenolic resin is applied to the paper web, it is dried to a B-phase before fluting.

Figure 12:
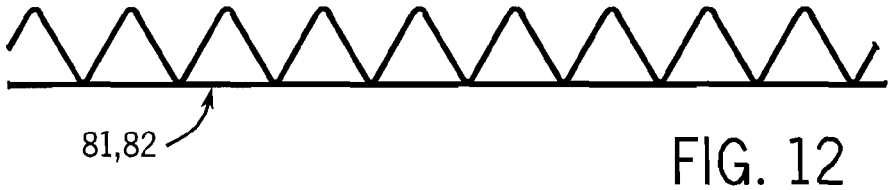
FIGS. 12-14 are cross sectional details of the progressive formation of an open core element from its component webs.
Figure 13:
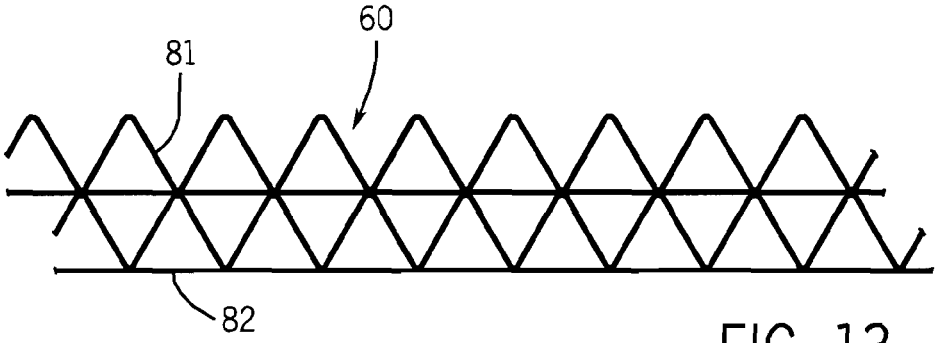
Figure 14:
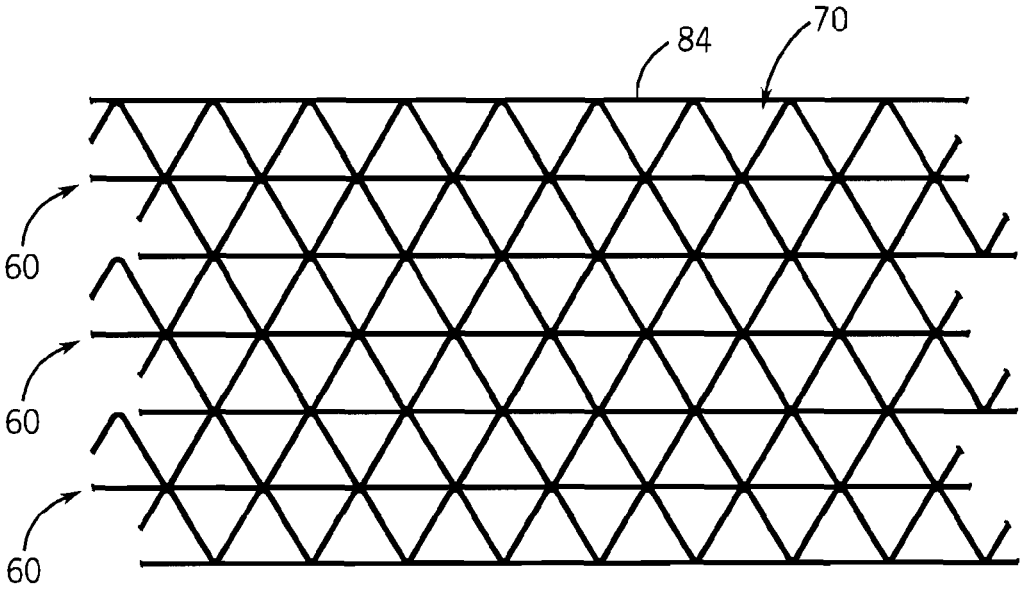
Figure 18:
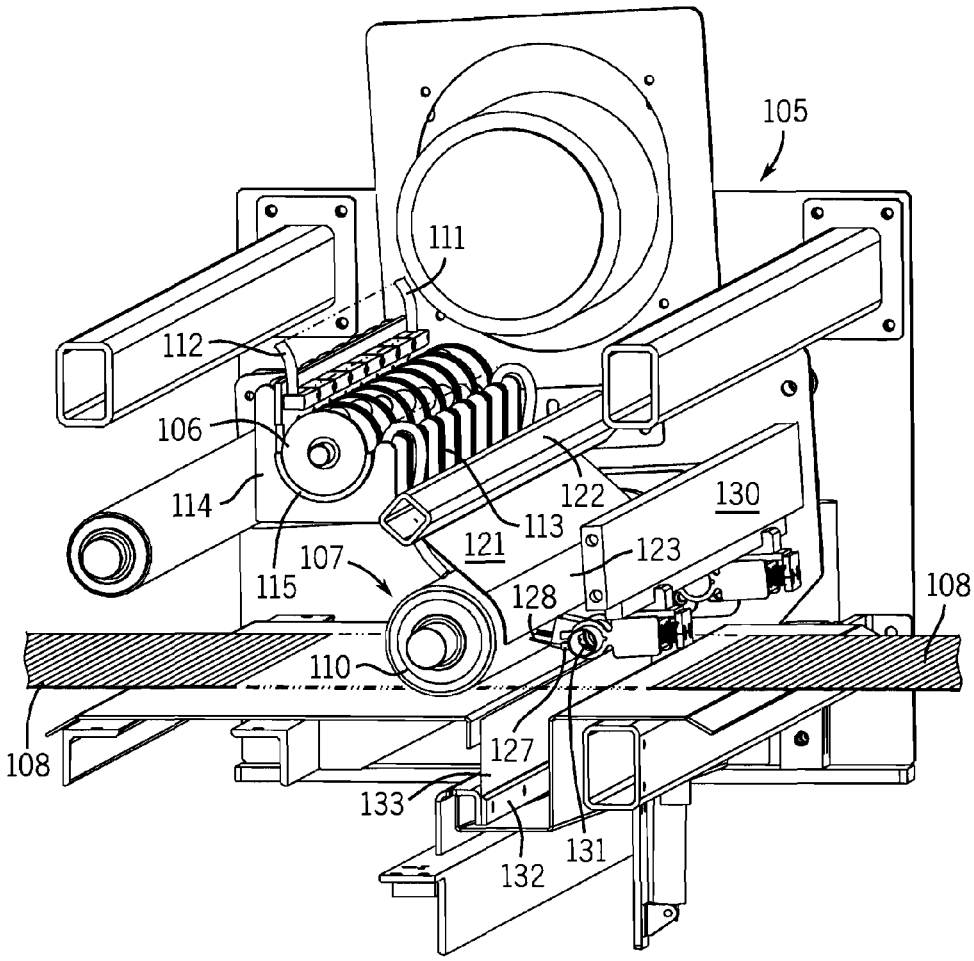
FIG. 18 is a perspective view of a glue machine for applying a liquid adhesive to a fluted web.
Figure 19:
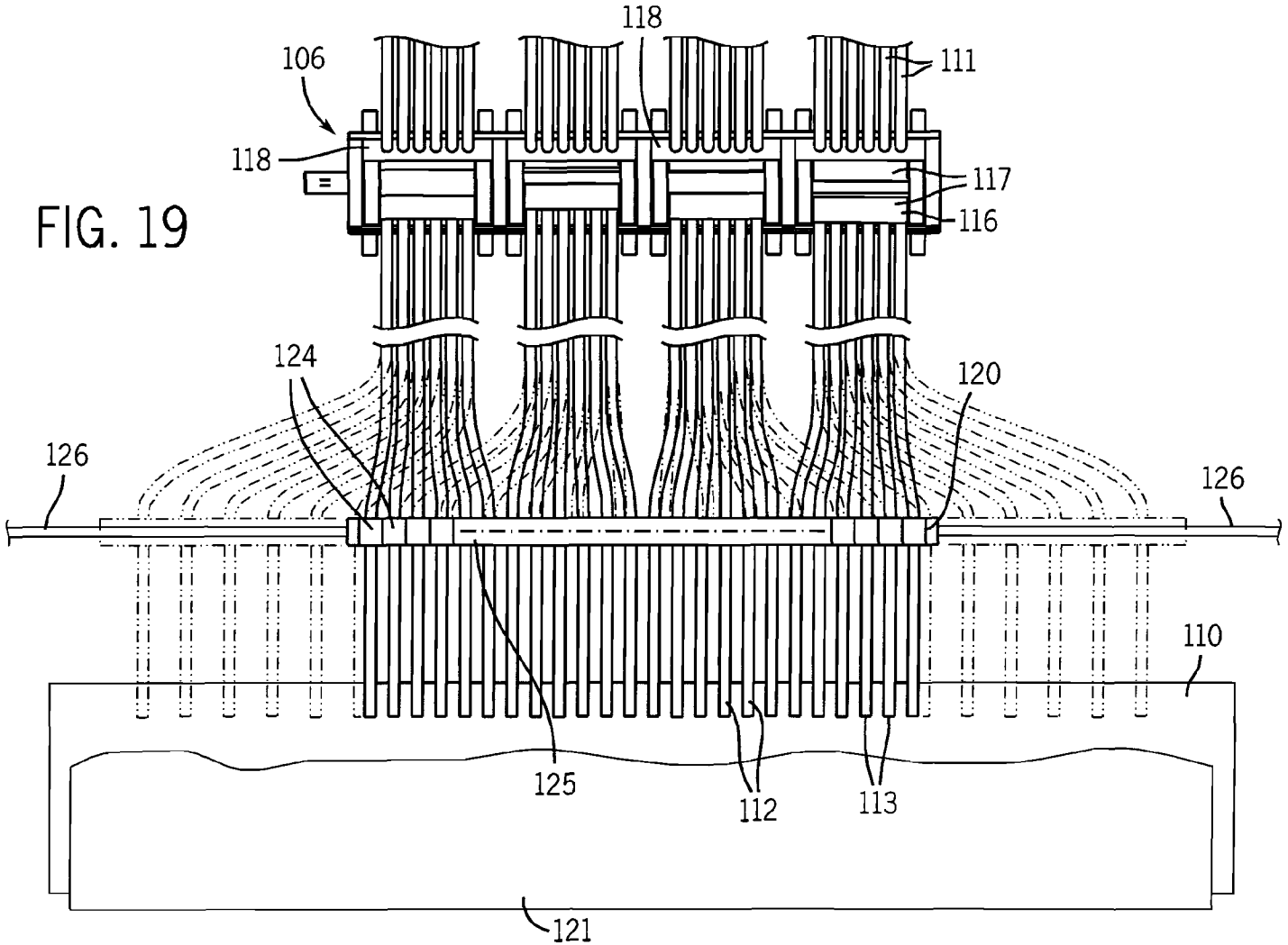
FIG. 19 is a schematic top plan view of the glue machine of FIG. 18.

In accordance with the overall system of the present invention for producing open core elements, fluted webs are joined with an adhesive to plain unfluted webs in various steps of the operation to progressively form the open core elements as shown schematically in FIGS. 12-14. In the system previously described, for example, glue rolls 23 (FIG. 1), 80 (FIG. 7), 30 (FIG. 3), 64 (FIG. 8) and 109 (FIGS. 15 and 20) are used to apply a liquid adhesive to the flute tips of a fluted web. FIGS. 18 and 19 show a glue machine which may include any of the glue rolls just identified.

In FIG. 18, a glue machine 105 includes a pump 106 for supplying a liquid adhesive, such as an aqueous starch-based adhesive, and a glue roll assembly 107 for applying the adhesive to the flute tips of an incoming web 108.

A presently preferred pump 106 comprises a ganged array of positive displacement pumps commonly driven to provide laterally spaced beads of adhesive to the glue roll 110 of the glue roll assembly 107. Preferably, the pump 106 comprises a ganged peristaltic pump which receives a supply of a liquid adhesive to the inlet ends 111 of laterally spaced flexible tubes 112 made of a suitable synthetic rubber, such as neoprene. The tubes extend through the pump 106 and terminate in outlet ends 113 evenly spaced laterally across the surface of the glue roll 110. The pump 106 may, for example, have 24 supply tubes 112 and, if the adhesive is being applied to a 48" web, the tubes 112 would be spaced at about 2" intervals.

The pump 106 includes a supporting frame 114 that has a semicylindrical backing surface 15 and a driven rotating roller assembly 116 that has an axis of rotation coincident with the axis of the backing surface 115. In the embodiment shown, there are four laterally spaced roller assemblies, each of which carries three orbitally mounted rollers 117. The adhesive supply tubes 112 extend from an upstream tube harness 118 downwardly between the backing surface 15 and the roller assembly 116 to the outlet ends 113 of the tubes adjacent the surface of the glue roll 110. Rotation of the orbital rollers 117 brings individual rollers sequentially into contact with the tubes 112, squeezing them against the backing surface 115 and pushing accurately metered amounts of liquid adhesive through the tubes to the outlet ends 113. By carefully controlling the supply of liquid adhesive to the inlet ends 111 of the tubes 112, the pre-calculated exact volume of adhesive desired to be applied to the web is delivered by the pump to the glue roll. In this manner, the pump supplies only the volume of adhesive needed and there is no need to recirculate unused adhesive which could be contaminated or otherwise unsatisfactory for reuse. Once the starch formula has been used to calculate the mix of starch and water (with other well known additives), the volume to be supplied to the pump and the transferred to the glue roll is calculated based on pump rotational speed, web speed and web width. One important benefit of utilizing a peristaltic pump apparatus is that none of the pump mechanism, except the tubes 112, is contacted by the adhesive. This minimizes adhesive build up on internal parts and facilitates considerably the cleaning of the glue machine, as will be described.

The outlet ends 113 of the adhesive supply tubes 112 are attached to a tube outlet support assembly 120 extending across the width of the glue machine 105 above the glue roll 110. The glue roll assembly 107 includes a flexible adhesive spreading tongue 121 that has its upper edge attached to a tongue support 122 and a free downstream end 123 that is shaped to lie against and conform to the cylindrical surface of the glue applicator roll 110. The beads of liquid adhesive supplied to the glue roll surface upstream of the shaped end 123 of the spreading tongue 121 are smoothed into a uniform layer on an engraved surface on the glue roll 110 from which it is applied to the flute tips of the incoming web 108 that makes tangent contact with the glue roll 110.

The outlet ends 113 of the adhesive supply tubes 112 are mounted on the support assembly 120 such that their positions can be selectively adjusted to a desired spacing in order to accommodate different width webs 108. In the embodiment shown in FIG. 19, each tube end 113 is carried on a separate tube holder 124 and all of the tube holder are mounted on an elastic band 125 that is partially stretched to provide an initial closely spaced array. By stretching the band equally and in opposite directions, as with a lead screw arrangement 126, the tube holders 124 and attached tube ends 113 may be moved to an increased spacing.

The glue machine 105 also includes a laterally adjustable adhesive width control assembly 127 that includes a pair of laterally adjustable doctor blades 128 which may be moved into contact with the glue roll surface to remove unneeded adhesive and to define the width of the glue layer to be applied to the incoming web 108. The doctor blades 128 are slidably mounted on a lateral support member 130 and each doctor blade assembly includes a vacuum connection 131 to carry unused glue away. When the glue supply from the pump 106 is terminated, the inlet ends 111 of the glue supply tubes 112 are supplied with a cleaning fluid that travels through the tubes, onto the glue roll and mating face of the spreading tongue 121 and over the cleaning doctor blade 133.

It is also preferable to mount the adhesive supply tubes 112 so they can be adjusted axially in the tube harness to change their positions to present different areas to contact by the pump rollers 117. In this manner, the points at which constant intermittent squeezing of the tubes occurs can be changed to present fresh unstressed tube portions to the rollers.

In FIG. 20, there is shown the use of the large flute forming apparatus of FIG. 15 to make a single face fluted web 134. The fluted web 103 is retained on the fluting roll 85 where a liquid adhesive is applied by a glue roll 109 to the flute tips of the web 103. Further downstream, a web delivery or generator roll 135 brings a liner web 136 into contact with the glued flute tips of the fluted web 103.

In FIG. 21, there is shown an adaptation of the large flute forming apparatus of FIG. 15 for forming a composite double medium, single liner fluted web 140. The apparatus includes a pair of fluted rolls 85 and 85' that are mounted for counter rotation in closely spaced relation and with their teeth in register to form a nip 137. A counterroll 91, 91' is positioned diametrically opposite the nip 137 and in counter rotating engagement with the respective fluted roll 85, 85'.

Each of the incoming medium webs 97 and 97' is provided with the large flutes, as previously described, and exits the fluting nip in contact with the fluted roll 85 and 85'. An adhesive is applied to the flute tips of the respective fluted webs 103 and 103' by glue rolls 109 and 109', respectively. A web delivery roll 135 brings a liner web 136 into intimate contact with the glued flute tips of lower fluted web 103. The resulting single face web 138 enters the nip 137 where it is joined with the glued flute tips of fluted web 103' to form the composite double medium, single liner fluted web 140. It may be advantageous to retain the composite web 140 on one or the other of the fluted rolls 85 and 85' to take advantage of the heat to enhance the attainment of green bond strength for further processing.

Downstream of the nip 137, the web 140 may be slit longitudinally on slit lines 141 (see FIG. 22) into a plurality of narrow strips 142 which may be, for example, ⅜" wide. The large flutes themselves, as previously described, may have a flute pitch of ¾" and a flute depth of ½". The narrow strips 142 are then die cut in the lateral or cross machine direction at the base of the gullet 143. The lateral die cuts 149 are made along the center of the glue line 144 so that the resulting small pieces 146 remain glued. In other words, where the gullets of the fluted webs 103 are joined to opposite sides of the liner web 136, each adjacent laterally cut web piece will share one-half of the glue line 144. If the lateral die cut slits 145 are made every other pitch length, as shown in FIG. 22, the resultant small web pieces 146 will have a sort of FIG. 8 shape which shape is stabilized and fairly rigid by the intermediate glued liner web 136.

The small web pieces 146 may be used as a substitute for the ubiquitous styrofoam packaging and filter "peanuts" that are fraught with environmental and disposal problems. Small web pieces 146 have a very low material weight-to-volume ratio, possess the necessary rigidity, and are recyclable or at least biodegradable. Furthermore, the process and apparatus of the present invention can use medium web stock 108 and liner web stock 136 that, in the corrugating industry, are referred to as "trim rolls". These are rolls of edge trim paper resulting from trimming a standard width (e.g. 96") roll of paper. Trim rolls of about 1 foot in axial length or less are typically discarded or repulped. Even trim rolls as long as 4 feet are difficult to dispose of. However, trim rolls of this range in axial lengths are well suited for the process of the present invention.

In FIG. 23 there is shown a modified apparatus for making open core elements in accordance with the present invention. A single face web 147 is formed in a single facer 148 by joining a liner web 150 from roll 151 to a corrugated medium web 152 from a roll 153 in a known manner. The single face web 147 exiting the single facer may be heated to enhance curing by moving over a heating plate 154 after which the web is slit longitudinally in a slitting knife 155 into a plurality of adjacent single face web strips 156. A glue roll 157 applies a suitable adhesive (e.g. starch) to the exposed flute tips of the medium web 152. The glued strips 156 are then separated and wound with the liner web 150 on the outside to form circular spiral open core elements 158. The elements may be wound to any desired diameter with the strips 156 cut in a cutoff knife 160 to establish the desired diameters. Other control of the slitting knife 155 and cutoff knife 160 may be employed to provide core elements 158 of different thicknesses and/or diameters.

Whereas the open core elements 13 and 70 of the previously described embodiments are rectangular in shape and typically enclosed on both faces with rectangular skin sheets, circular core members 158 made in accordance with the FIG. 23 embodiment may also be used to form rectangular panels utilizing rectangular skin sheets. As shown, for example, in FIG. 24, a rectangular panel having opposite skin sheets 161 of say 12'×24' can utilize large 12' diameter core elements 162 with the peripheral spaces filled by say 2'-3' diameter small core elements 163. It is believed that spirally formed core elements 158 possess better strength in certain applications. Also, the simplified process and apparatus of FIG. 23 provides material handling advantages over the rectilinear processes of the previously described embodiments. A further and most important advantage in the manufacture of spirally wound circular open core elements is that very narrow strips 156, as thin as, for example, ½" may be processed. An attempt to handle such thin strips using the cross-transfer mechanism and methods of the previously described embodiments would likely not be successful.

Figure 25:
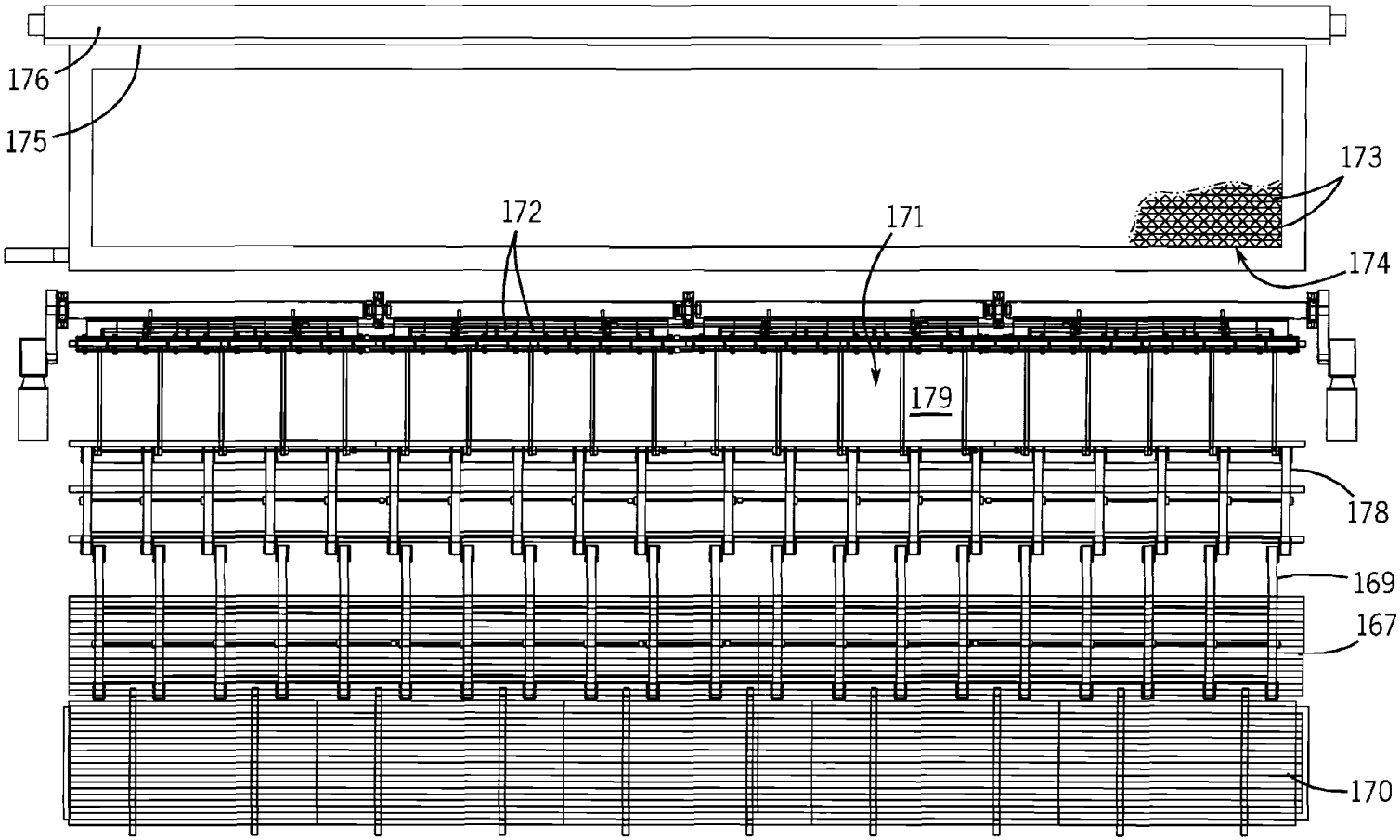
FIG. 25 is a top plan view of the downstream portion of a modified system for making open core elements.

Referring now to FIG. 25, there is shown an improved apparatus for the lay-up of hollow core elements, particularly suitable for the manufacture of hollow core elements having a depth or thickness suitable for the manufacture of floor and roof panels for building construction. As shown in my co-pending patent application Ser. No. 11/485,823, a 16 in. panel thickness for roof construction is typically suitable.

Figure 26:
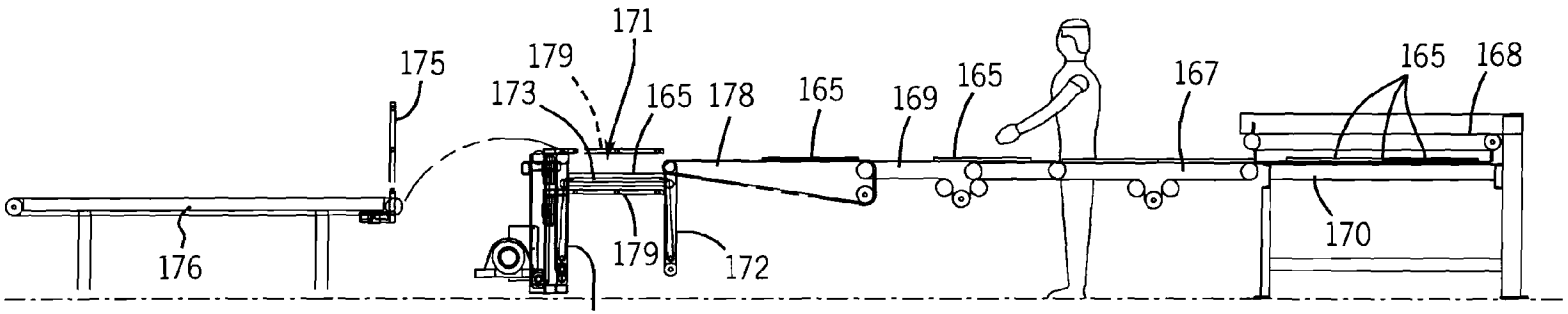
FIGS. 26 and 27 show operation of the FIG. 25 system in the respective formation and transfer modes for intermediate open core elements.
Figure 27:
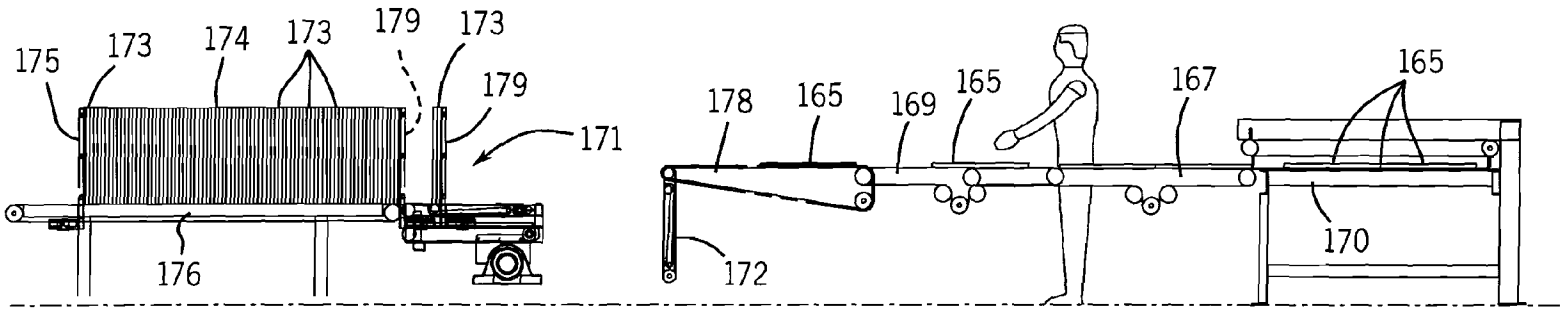
Figure 28:
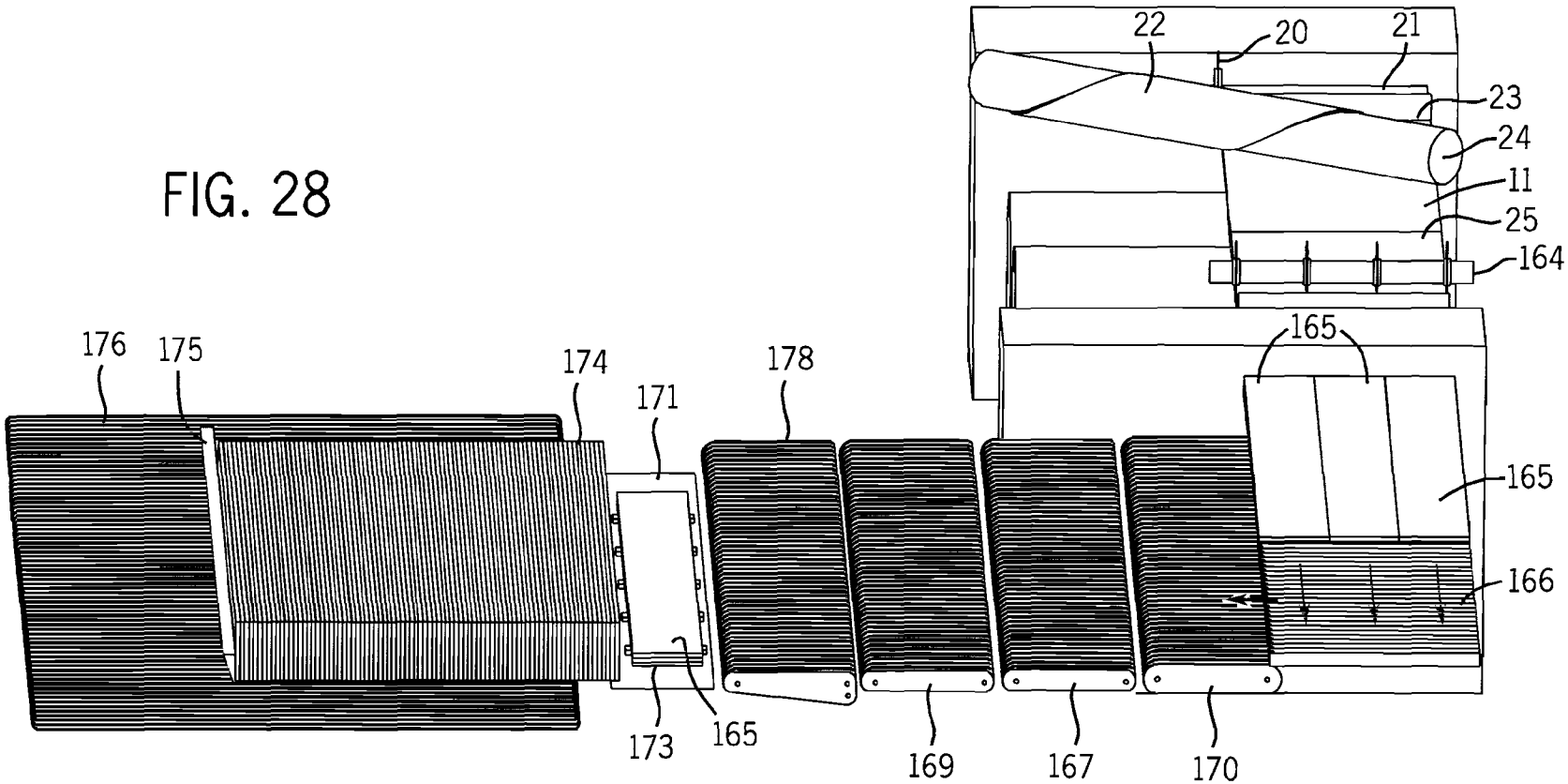
FIG. 28 is a generally schematic top plan view of the entire system for FIGS. 25-27.

In the system of FIGS. 25-27, a composite double wall open face web 25 is formed to a width of 48 in., as described above with respect to the FIG. 1 system. The web 25 is then slit longitudinally in a slitter 164 to form three 16 in. wide open face double wall strips 165. In a manner similar to that previously described, the strips 165 are oriented with the flutes on top and extending laterally. The strips are directed beneath a second glue roll 30 which applies a suitable adhesive to the exposed flute tips of the strips 165. When the group of three strips 165 reaches a selected length in the machine direction (e.g. 50 ft. for a roof panel), a cutoff knife cuts the strips to length. The three glued and cut strips 165 are accelerated on a transport conveyor 166 to form a gap between the strips and the next-following uncut strips. The strips are then transferred laterally on a cross transfer conveyor 170 onto an accumulation conveyor 167 using a cross transfer pusher 168. From the accumulation conveyor, a speed-up conveyor 169 accelerates the lead strip 165 and creates a gap between it and the next adjacent strip. The speed-up conveyor 169 delivers the strips individually onto a higher speed stacker infeed conveyor 178 that engages the upstream (rear) edge of the strip and launches the strip into the bay of a downstacker 171. The transfer of individual strips 165 into the downstacker 171 may be conveniently effected by engaging the upstream edge of the strip on the stacker infeed conveyor 178 with positive engagement dogs, or the like, using a servo drive for rapid acceleration.

In the stacker 171, the strips 165 are initially supported along both long edges with, for example, rotatable fingers positioned in spaced orientation along the strip edges. Both edges are released simultaneously and the strip drops vertically onto a supporting pan 179 out of the path of the next incoming strip. The strips 165 are preferably guided in their vertical descent on the pan 179 by engaging opposite narrow edges to assure that the strips are accurately aligned with one another in the stacker. Vertically moving arrays of guide belts 172 spaced along the strip edges are a presently preferred arrangement. The belts 172 are adjustable to vary the space between them for handling different width strips.

Because the strips 165 have fresh adhesive glue on the flute tips, the second incoming strip 165 will drop onto the first strip in the stacker where the smooth web underside of the second strip will engage and adhere to the glued flute tips of the first strip. The third strip will follow in the same manner and the result will be the formation in the stacker of a three-ply stack of open face double wall strips comprising an intermediate open core block 173.

Each three-ply intermediate open core block 173 is removed from the stacker 171 by lifting the pan 179 to the top of the stacker bay, and rotating the stacker 171 90° in the counterclockwise direction to upend the open core block 173 (from the FIG. 26 to the FIG. 27 position). Thereafter, it is moved horizontally into face-to-face relation with the block that precedes it. Glued flutes of each block, facing in the downstream direction, contact the smooth web face of the preceding block and, when deposited on an element forming conveyor 176, the blocks 173 are brought into adhesive contact. It may be desirable to apply vacuum to the block supporting pan 179 in the vertical upended position to hold the block until it is brought into contact with the preceding block.

The large building stack 174 moves against a stacking pan 175 on a core panel building conveyor 176. Because the lead face of the first block 173 has fresh adhesive applied upstream to the exposed flute tips, a face sheet must be inserted against the glued flute tips somewhere upstream of the FIG. 25 system. This avoids contact between the glued flute tips and the stacking pan 175. As shown in FIG. 14, each intermediate open core block 173 will thus comprise a three-ply stack of open face double wall strips 60 (including an end element facing sheet 84).

If a large open core panel is formed, such as might be used as a building floor or roof panel, each intermediate open core block 173 may have a thickness of 3 in., a width in vertical direction of 16 in. and a length, in the cross machine direction, of 50 ft. To form an open core roof or floor element having a width of 10 ft., 40 intermediate blocks 173 would be assembled on the core panel building conveyor 176. For this large an open core panel, strips 165 having a length of 50 ft. would be produced. However, the inherent stiffness of a three-ply double wall intermediate open core block 173 makes these intermediate blocks much easier to handle. After the formation of a large 50 ft.×10 ft.×16 in. deep roof or floor panel, the panel is moved out of the apparatus on a suitable panel discharge conveyor. Subsequently, a floor or roof panel is completed by affixing upper and lower skin sheets to the open core panel 174 in accordance with the teachings in my co-pending application Ser. No. 11/485,823, filed Jul. 13, 2006, and Ser. No. 11/777,002, filed Jul. 12, 2007.

We claim:

1. A method for the manufacture of open core elements, comprising the steps of:

(1) forming two composite web halves, each comprising a smooth web and a fluted web;

(2) orienting said composite web halves with the exposed fluted web flutes facing up;

(3) applying an adhesive to the exposed flute tips of one web half;

(4) adhering the other web half by its smooth web to the glued flute tips of said one web half to form an open face double wall web;

(5) slitting the open face double wall web longitudinally to form a plurality of adjacent equal width open face double wall strips;

(6) applying an adhesive to the exposed flute tips of said open face double wall strips;

(7) cutting said strips transversely to a common selected length, (8) conveying each strip in the lateral direction individually and serially into a vertical stacker;

(9) dropping each strip vertically in the stacker such that each strip, after the lead strip, is deposited on the glued flute tips of the preceding strip to form an intermediate open core block of strips;

(10) upending the intermediate block onto a lateral block edge to orient the exposed glued flute tips of the last deposited strip to face in the lateral downstream direction; and,

(11) conveying the intermediate block in the lateral downstream direction to bring the exposed glued flute tips into bonding contact with the exposed smooth web face of a preceding intermediate block to form the open core element.

2. The method as set forth in claim 1 including, prior to the step of adhering said other web half to said one web half, the step of aligning the flute tips of the web halves tip-to-tip.

3. The method as set forth in claim 1 including the steps of:

(1) forming a double width composite web; and, (2) slitting the double width web to form said two composite web halves.

* * * * *